US006647870B2

(12) United States Patent
Kohno

(10) Patent No.: US 6,647,870 B2
(45) Date of Patent: Nov. 18, 2003

(54) DRIVE APPARATUS, PRESS MACHINE SLIDE DRIVE APPARATUS AND METHOD THEREOF

(75) Inventor: Yasuyuki Kohno, Kiyose (JP)

(73) Assignee: Aida Engineering, Ltd., Sagamihara (JP)

( * ) Notice: Subject to any disclaimer, the term of this patent is extended or adjusted under 35 U.S.C. 154(b) by 31 days.

(21) Appl. No.: 09/994,665

(22) Filed: Nov. 28, 2001

(65) Prior Publication Data

US 2002/0096060 A1 Jul. 25, 2002

(30) Foreign Application Priority Data

Dec. 5, 2000 (JP) ..... 2000-370242

(51) Int. Cl.[7] ..... B30B 1/23

(52) U.S. Cl. ..... 100/269.14; 100/35; 100/289; 60/476

(58) Field of Search ..... 100/269.01, 269.14 DR, 100/270, 271, 35, 289, 214, 50, 230; 60/476, 413, 414, 446, 448, 418

(56) References Cited

U.S. PATENT DOCUMENTS

| | | | | | |
|---|---|---|---|---|---|
| 4,209,987 | A | * | 7/1980 | Kononov et al. | 60/413 |
| 4,563,889 | A | | 1/1986 | Landwehr | |
| 4,756,156 | A | * | 7/1988 | Appel | 60/426 |
| 5,460,084 | A | * | 10/1995 | Otremba et al. | 100/35 |
| 5,568,766 | A | * | 10/1996 | Otremba et al. | 100/35 |
| 5,852,933 | A | * | 12/1998 | Schmidt | 60/413 |
| 6,085,520 | A | * | 7/2000 | Kohno | 60/414 |

FOREIGN PATENT DOCUMENTS

| | | | |
|---|---|---|---|
| DE | 3834918 | * | 7/1989 |
| DE | 38 34 918 A1 | | 7/1989 |
| EP | 0 873 853 A2 | | 10/1998 |
| EP | 0 947 259 A2 | | 10/1999 |
| JP | 58224100 | * | 12/1983 |
| JP | 62 297 000 | | 12/1987 |
| JP | 01 309 797 | | 12/1989 |
| JP | A 1-309797 | | 12/1989 |
| JP | B2 2506657 | | 4/1996 |
| JP | 10 166 199 | | 6/1998 |

* cited by examiner

*Primary Examiner*—Allen Ostrager
*Assistant Examiner*—Shelley Self
(74) *Attorney, Agent, or Firm*—Oliff & Berridge, PLC

(57) ABSTRACT

An electric motor and hydraulic pump/motor are combined on a torque level, a press machine is controlled with controllability of an electric motor, and kinetic energy of a slide is regenerated during braking without constraints of slide pressurization or an amount of energy. A screw press drives a slide through a screw mechanism made up of a drive nut and a driven screw. The drive nut is provided with a ring gear integral therewith and this ring gear is engaged with a gear provided for a drive axis of an electric motor and a gear provided for the drive axis of a hydraulic pump/motor. The hydraulic pump/motor is connected to a constant high pressure source that generates a quasi-constant pressure hydraulic liquid and a low pressure source. This allows the electric motor and hydraulic pump/motor to be combined on a torque level.

47 Claims, 21 Drawing Sheets

WHEN RESPONSIVITY OF HYDRAULIC P/M IS NOT CONSIDERED

WHEN RESPONSIVITY OF HYDRAULIC P/M IS CONSIDERED

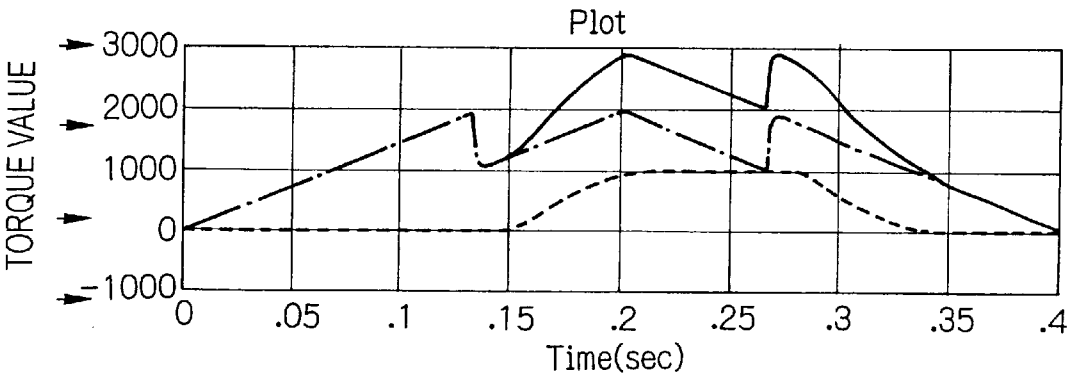
F I G. 9 (A)
WHEN RESPONSIVITY OF HYDRAULIC P/M IS NOT CONSIDERED
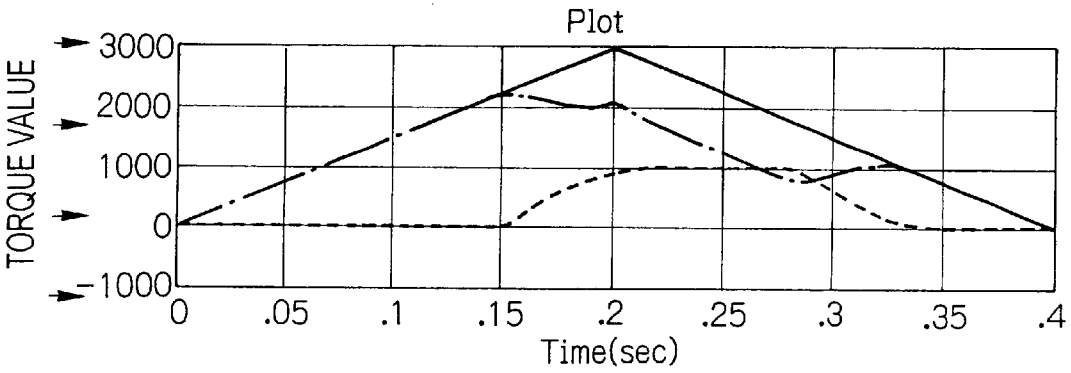
F I G. 9 (B)
WHEN RESPONSIVITY OF HYDRAULIC P/M IS CONSIDERED
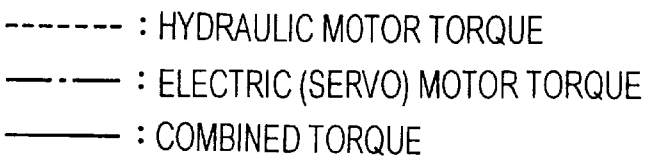

DRIVE APPARATUS, PRESS MACHINE SLIDE DRIVE APPARATUS AND METHOD THEREOF

BACKGROUND OF THE INVENTION

1. Field of the Invention

The present invention relates to a drive apparatus, a press machine slide drive apparatus and a method, and more particularly, to a drive apparatus, a press machine slide drive apparatus and a method using an electric motor and a hydraulic pump/motor such as oil hydraulic pump/motor together.

2. Description of the Related Art

There are conventional press machine slide drive apparatuses as shown below:

(a) An electric press that servo-drives the slide directly or indirectly (via a reduction gear, etc.) by an electric (servo) motor (only) (Japanese Patent No. 2506657).

(b) The press machine slide drive apparatus described in U.S. Pat. No. 4,563,889 drives the slide via a variable discharge capacity hydraulic pump, (a plurality of) hydraulic motors and screws.

(c) There is also a type of press machine slide drive apparatus that drives a machine press crank axis using a hydraulic circuit similar to above-described (b) (Japanese Patent Application Publication No. 1-309797, etc.). Furthermore, Japanese Patent Application Publication No. 1-309797 discloses the technology of providing a flywheel between an electric motor and variable capacity pump/motor and storing energy in this flywheel.

(d) A press machine slide drive apparatus which is provided with an electric motor that rotates and drives a fixed discharge capacity pump capable of discharging in both directions and is driven by a hydraulic cylinder and hydraulic motor connected to the pump (Japanese Patent Application Publication No. 10-166199).

The electric press in (a) described above can obtain a high degree of control over the slide, but cannot secure (provides insufficient) work performance (energy performance) which is an important performance element of a press machine or molding machine. This is because the electric press servo-driven by the electric servo motor does not have the function of storing energy and the amount of energy obtained from the motor during molding is limited.

Solving this problem requires provision of an electric motor with considerably high output (W), which in turn requires an enormous amount of the corresponding power reception capacity (facility) on the user side. Furthermore, during acceleration or deceleration or uniform motion not involving molding of the slide, the electric motor handles a small workload associated with extremely low load torque, and is therefore unable to use surplus torque (energy) effectively.

Moreover, the press machine slide drive apparatus in (b) described above has a problem with slide controllability (responsiveness and static (velocity and position) accuracy). That is, the force required to drive the slide is proportional to the pressure (load pressure) produced when the amount of oil flowing per unit time discharged by the variable discharge capacity pump is compressed in a conduit connected to the hydraulic motor caused by the load produced, and therefore the dynamic characteristic of the slide decreases due to a response delay caused by the compression (responsivity, velocity and position feedback gain decrease).

Furthermore, leakage of the hydraulic oil proportional to the load pressure is produced from the variable discharge capacity hydraulic pump, hydraulic motor and valves, which drastically reduces the velocity and positional accuracy especially during molding during which the load pressure increases. Moreover, since the slide is driven mainly under control over the amount of oil by the variable capacity pump motor, a large amount of oil flowing per unit time is required, which is likely to increase the scale of the equipment.

In addition to the problem in (b), the press machine slide drive apparatus in (c) described above has a non-linear characteristic from the drive axis driven by the hydraulic motor to the slide, causing an additional problem of adding constraints to the slide pressurization value, etc.

Moreover, the press machine slide drive apparatus in (d) described above has also a problem of drastically decreasing controllability of the electric motor (affected by compressibility of oil pressure and leakage of the hydraulic oil) by letting the oil pressure stand in some midpoint of the drive section. Furthermore, the press machine slide drive apparatus in (d) described above inherits the problem specific to control of an electric motor of not being provided with an energy storing function and the work-load required for press pressurization and press molding is limited by maximum instantaneous output of the electric motor. On the other hand, its advantage is limited to the ability to construct a system easily.

As shown above, for the conventional press machine slide drive apparatus, etc., a type of driving the slide by an electric (servo) motor has been designed with prime importance placed on controllability, but the magnitude of slide pressurization and energy performance are drastically decreased considering its capacity (size of the motor, output (W), power reception capacity). On the other hand, the drive (by a variable capacity pump) using a hydraulic pressure makes it possible to freely secure pressurization and energy, but nonetheless deteriorates its controllability considerably due to compression of the hydraulic oil and leakage of the hydraulic oil. These types have both advantages and disadvantages. In contrast to these types, there is also a type of driving the hydraulic pump with an electric (servo) motor, but this still includes both types of problems and cannot contribute to functional solutions.

SUMMARY OF THE INVENTION

The present invention has been achieved in view of the above-described circumstances, and has as its object the provision of a drive apparatus, press machine slide drive apparatus and method capable of combining an electric motor and a hydraulic pump/motor such as oil hydraulic pump/motor on a torque level, controlling the press machine using controllability of the electric motor and regenerating kinetic energy of the slide during braking without being constrained by slide pressurization and amount of energy (performance).

In order to attain the above-described object, the present invention is directed to a drive apparatus comprising: an electric motor, a fixed capacity type or variable capacity type hydraulic pump/motor connected to a constant high pressure source that generates a quasi-constant pressure hydraulic liquid and a low pressure source and a torque transmission device which connects a drive axis and the electric motor in such a way that torque is transmitted between drive axis and electric motor and connects the drive axis and hydraulic pump/motor in such a way that torque is transmitted between the drive axis and hydraulic pump/motor.

Furthermore, the present invention is directed to a press machine slide drive apparatus comprising: an electric motor, a fixed capacity type or variable capacity type hydraulic pump/motor connected to a constant high pressure source that generates a quasi-constant high pressure hydraulic liquid and a low pressure source, a slide drive mechanism which drives a slide of a press machine and a power transmitting device which connects a drive axis of the slide drive mechanism and the electric motor in such a way that torque is transmitted between the drive axis of slide drive mechanism and the electric motor and connects the drive axis and the hydraulic pump/motor in such a way that torque is transmitted between the drive axis and hydraulic pump/motor.

That is, according to the present application, the electric motor and hydraulic pump/motor are used together and especially the constant high pressure source that generates a quasi-constant pressure hydraulic liquid and a low pressure source are connected to the hydraulic pump/motor to thereby eliminate torque response delays of the hydraulic pump/motor, thus making it possible to realize a combination with the electric motor on a torque level, control the press machine with controllability of the electric motor and freely secure the magnitude of slide pressurization and energy.

The present invention is directed to a press machine slide drive apparatus comprising: an electric motor, a fixed capacity type or variable capacity type hydraulic pump/motor connected to a constant high pressure source that generates a quasi-constant pressure hydraulic liquid and a low pressure source, a plurality of slide drive mechanisms which drives one slide of the press machine and a power transmission device which connects each drive axis and the electric motor in the plurality of slide drive mechanisms in such a way that torque is transmitted between each drive axis and the electric motor and connects each drive axis and the hydraulic pump/motor in such a way that torque is transmitted between the each drive axis and the hydraulic pump/motor.

According to the present application, one slide is driven by drive axes of a plurality of slide drive mechanisms, and therefore it is possible, even when decentered press weight is applied to the slide, to realize torque control according to the decentered press weight and maintain the parallelism of the slide with high accuracy.

The present invention is directed to a press machine slide drive method comprising a step of driving an electric motor and generating torque, a step of generating torque from a fixed capacity type or variable capacity type hydraulic pump/motor by connecting the hydraulic pump/motor to a constant high pressure source which generates a quasi-constant high pressure hydraulic liquid and a low pressure source and a step of combining and acting the output torque of the electric motor and the output torque of the hydraulic pump/motor on the drive axis when the output torque of at least the single electric motor unit is not sufficient as the torque output to the drive axis of the press machine slide drive mechanism.

That is, when a large slide pressure is required and the output torque of the electric motor alone is not enough, this embodiment combines the output torque of the electric motor with the output torque of the hydraulic pump/motor to assist the slide in obtaining the required pressure.

The present invention is directed to a press machine slide drive method comprising a step of rendering the hydraulic pump/motor to operate as a hydraulic pump when load in one cycle of the press machine is low, a step of generating torque larger than the torque necessary during the low load from the electric motor in such a way as to balance with the low load and the load of the hydraulic pump/motor and a step of storing surplus energy caused by surplus torque of the electric motor caused by the pump operation of the hydraulic pump/motor in the constant high pressure source as a hydraulic liquid.

That is, when the press machine is operating with low load such as uniform motion, this embodiment operates the hydraulic pump/motor as the hydraulic pump and generates larger torque by an amount corresponding to the load of this hydraulic pump/motor from the electric motor than torque required for the low load operation. As a result, the pump operation of the hydraulic pump/motor causes the surplus energy accompanying the surplus torque of the electric motor to be stored (charged) in the constant high pressure source as the hydraulic liquid.

Preferably, the press machine slide drive method further comprises a step of rendering the hydraulic pump/motor to operate as a hydraulic pressure pump when the slide is decelerated in one cycle of the press machine and storing the whole or part of the kinetic energy of the slide in the constant high pressure source as a hydraulic liquid.

That is, this embodiment regenerates the kinetic energy retained by the slide into the constant high pressure source via the hydraulic pump/motor during deceleration (braking) operation of the slide and makes braking torque act on the slide as a regenerative reaction force for effective utilization of energy.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein:

FIGS. 9(A) and 9(B) are graphs showing a relationship between torque of the electric motor and the hydraulic pump/motor and combined torque that combines these types of torque;

DETAILED DESCRIPTION OF THE PREFERRED EMBODIMENTS

Hereunder a preferred embodiment will be described in detail for a structure of a drive apparatus, press machine slide drive apparatus and method according to preferred embodiments of the present invention in accordance with the accompanied drawings.

Figure 1:
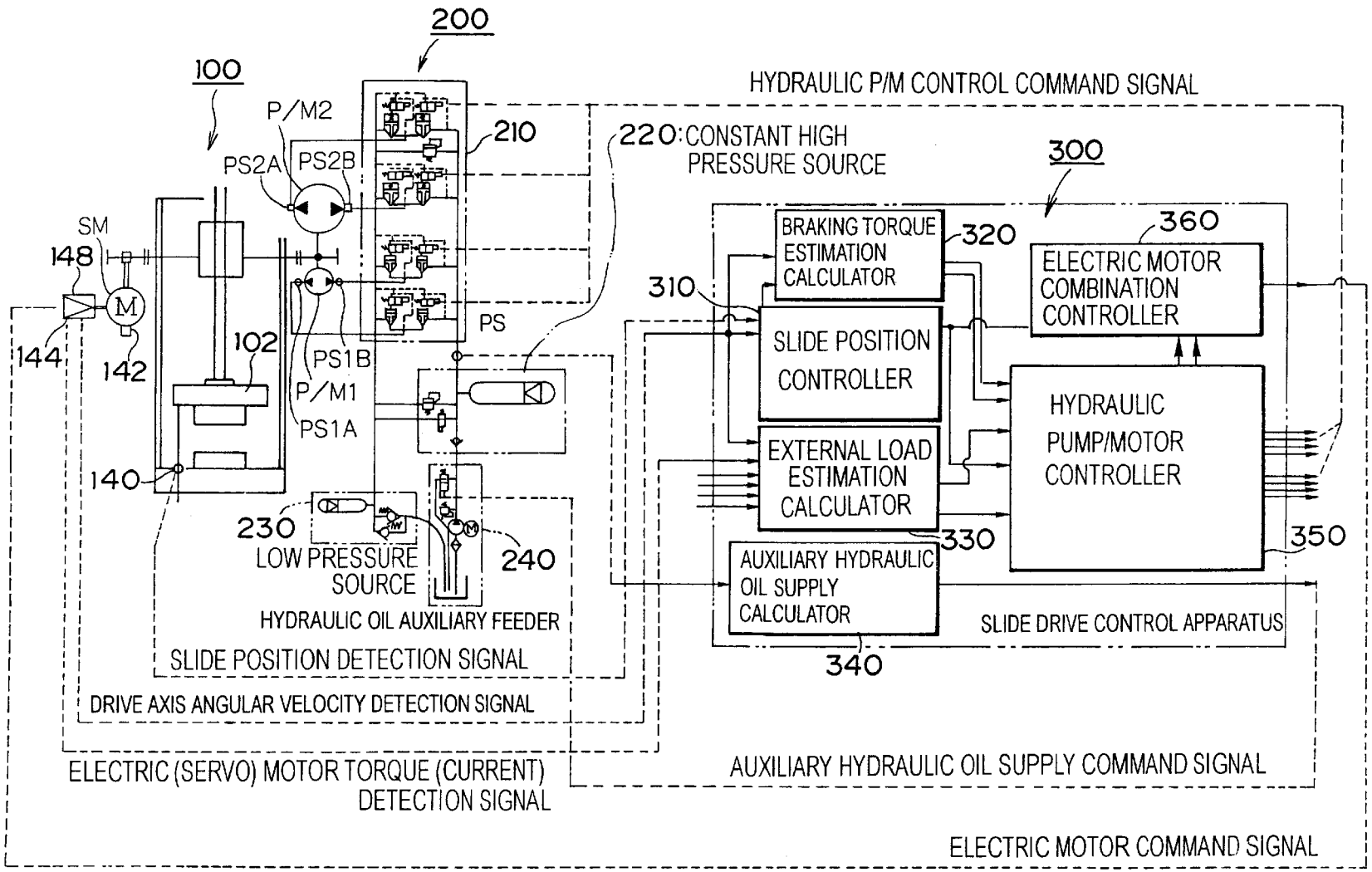
FIG. 1 is a schematic view showing an overall configuration of a press machine slide drive apparatus according to the present invention.

FIG. 1 is a schematic view showing an overall configuration of a press machine slide drive apparatus according to an embodiment of the present invention. As shown in FIG. 1, this slide drive apparatus drives a slide 102 of a screw press 100 and is mainly constructed of an electric (servo) motor SM, hydraulic pumps/motors P/M1 and P/M2, a hydraulic pump/motor drive apparatus 200 and a slide drive control apparatus 300.

Figure 2:
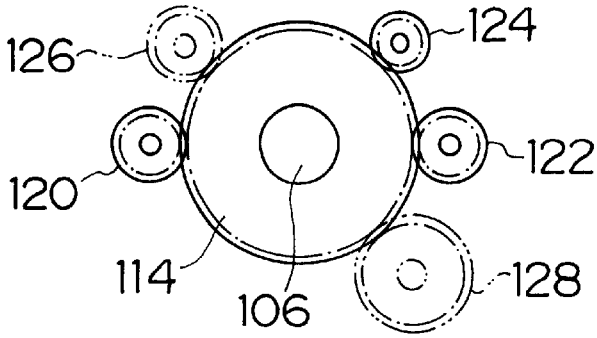
FIGS. 2(A) and 2(B) illustrate a detailed structure of a screw press shown in FIG. 1.
Figure 2:
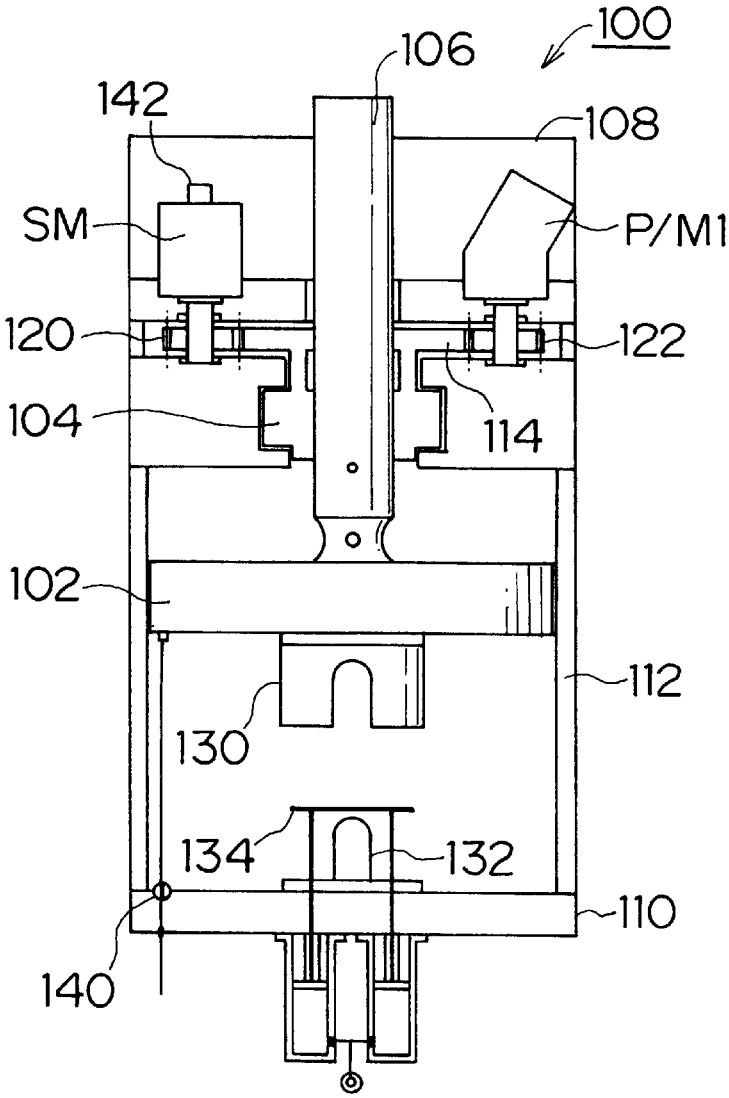

First, the screw press 100 to which the present invention is applied will be explained with reference to FIGS. 2(A) and 2(B). As shown in FIG. 2(B), this screw press 100 is a nut rotary type screw press and has a screw mechanism comprising a drive nut 104 as a drive mechanism for the slide 102 and a driven screw 106. The drive nut 104 is directly or indirectly supported in a pivotable manner by one of a crown 108, a bed 110 and a column 112 each fastened thereto and the driven screw 106 to the lower end of which the slide 102 is connected is mated with the drive nut 104.

The drive nut 104 forms one body with a ring gear 114 and this ring gear 114 is engaged with a gear 120 which is provided for the drive axis of the electric motor SM and at the same time is engaged with gears 122 and 124 (see FIG. 2(A)) provided for the drive axes of two hydraulic pumps/motors P/M1 and P/M2 (see FIG. 1).

By the way, it is also possible to provide another electric motor SM' and hydraulic pump/motor P/M3 (see FIG. 3) and engage gears 126 and 128 (see FIG. 2(A)) provided for these drive axes with the ring gear 114. Furthermore, the power transmission mechanism between the electric motor, the drive axis of hydraulic pump/motor and the ring gear 114 is not limited to the embodiment shown in FIGS. 2(A) and 2(B) and it is possible to adopt any gear reduction method or any number of gear reduction stages for this power transmission mechanism.

As shown in FIG. 2(B), the screw press 100 comprises a cope 130, a drag 132, a holddown 134, a slide position detector 140, and a drive axis angular velocity detector 142. More specifically, the slide position detector 140 detects the position of the slide 102 by measuring the distance between the slide 102 and bed 110 and outputs a slide position signal indicating the position of the slide 102. Furthermore, the drive axis angular velocity detector 142 detects the angular velocity of the drive axis of the electric motor SM and outputs a drive axis angular velocity signal indicating the angular velocity of the drive axis. The slide position detector 140 can be constructed of various sensors such as an incremental type or absolute type linear encoder, potentiometer or magne-scale. On the other hand, the drive axis angular velocity detector 142 can be constructed of an incremental type or absolute type rotary encoder or tachogenerator.

Next, the hydraulic pump/motor drive apparatus 200 shown in FIG. 1 will be explained with reference to FIG. 3.

This hydraulic pump/motor drive apparatus 200 is mainly constructed of a hydraulic oil switching control section 210 that switches between hydraulic oils supplied to the hydraulic pumps/motors P/M1, P/M2 (P/M3), a constant high pressure source 220, a low pressure source 230 and a hydraulic oil auxiliary feeder 240.

Figure 3:
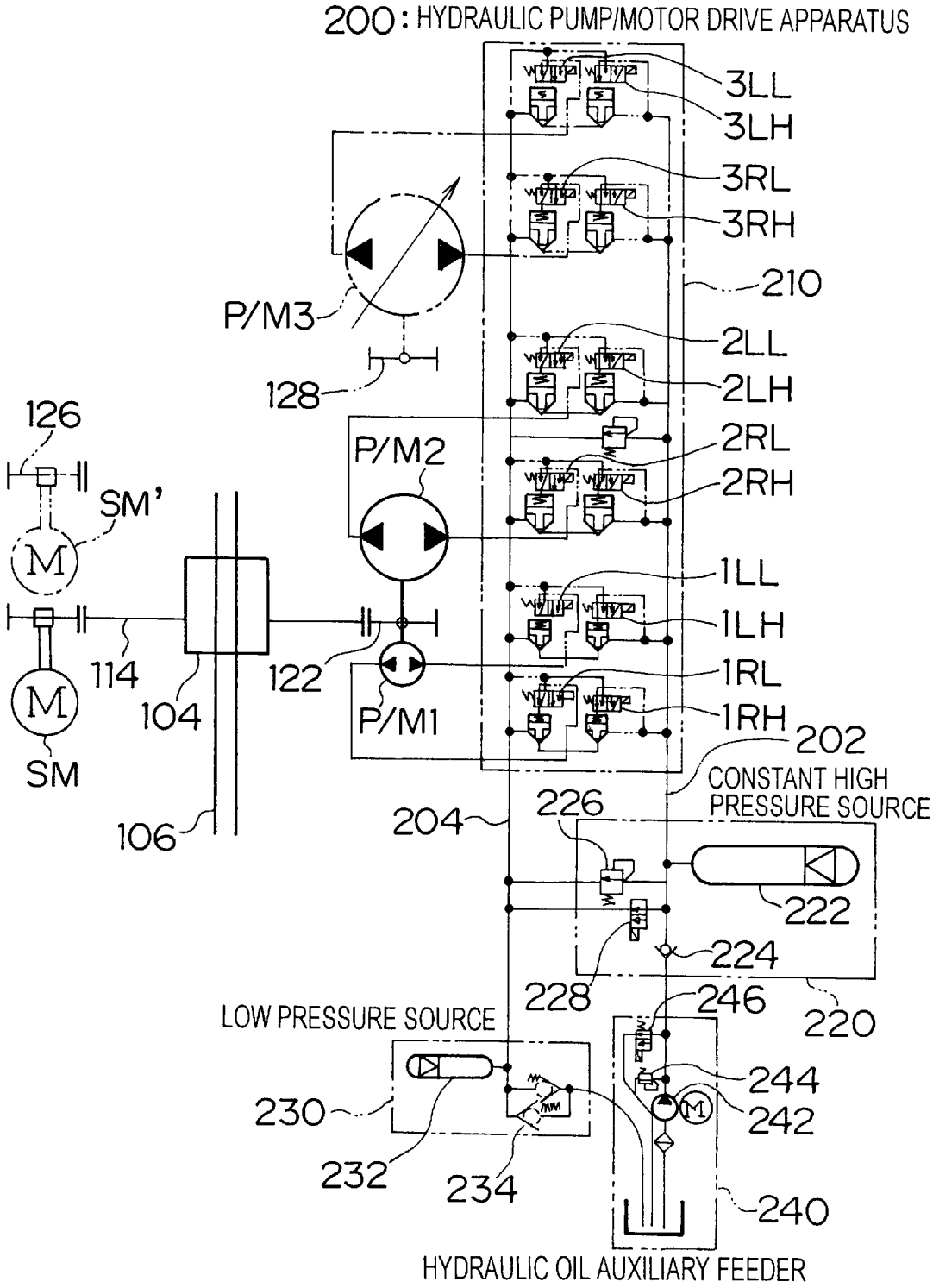
FIG. 3 illustrates an embodiment of a hydraulic pump/motor drive apparatus shown in FIG. 1.

The hydraulic oil switching control section 210 is provided with logic valves whose ON/OFF is controlled by electromagnetic switching valves 1RH, 1RL, 1LH, ILL, 2RH, 2RL, 2LH, 2LL, (3RH, 3RL, 3LH, 3LL) and each logic valve on the right-hand side in FIG. 3 is connected to a pipe 202 on the constant high pressure source 220 side and each logic valves on the left-hand side is connected to a pipe 204 on the low pressure source 230 side.

The constant high pressure source 220 is provided with an accumulator 222, a check valve with a spring 224, a high pressure relief valve 226 and an electromagnetic switching valve 228, the low pressure source 230 is provided with an accumulator 232, check valves with a spring 234 and 236 and the hydraulic oil auxiliary feeder 240 is provided with a hydraulic pump 242 which is driven by the electric motor, a high pressure relief valve 244 and an electromagnetic switching valve 246.

The circuit pressure of the pipe 202 on the high pressure side is detected by a pressure sensor PS as shown in FIG. 1 and its detection signal is output to an auxiliary hydraulic oil supply calculator 340 in the slide drive control apparatus 300. The auxiliary hydraulic oil supply operator 340 controls ON/OFF of the electromagnetic switching valve 246 of the hydraulic oil auxiliary feeder 240 according to the detection signal from the pressure sensor PS so that the pressure (pressure on the high pressure side) of the accumulator 222 of the constant high pressure source 220 becomes a quasi-constant high pressure (e.g., approximately 16 MPa). The hydraulic oil discharged from this hydraulic oil auxiliary feeder 240 flows into the pipe 202 on the high pressure side and the accumulator 222 via the check valve with a spring 224 to increase the circuit pressure on the high pressure side.

On the other hand, the pressure (circuit pressure on the low pressure side) of the accumulator 232 in the low pressure source 230 connected to the pipe 204 on the low pressure side is kept to a quasi-constant low pressure (e.g., approximately 500 kPa) by the check valve with a spring 234.

Figure 4:
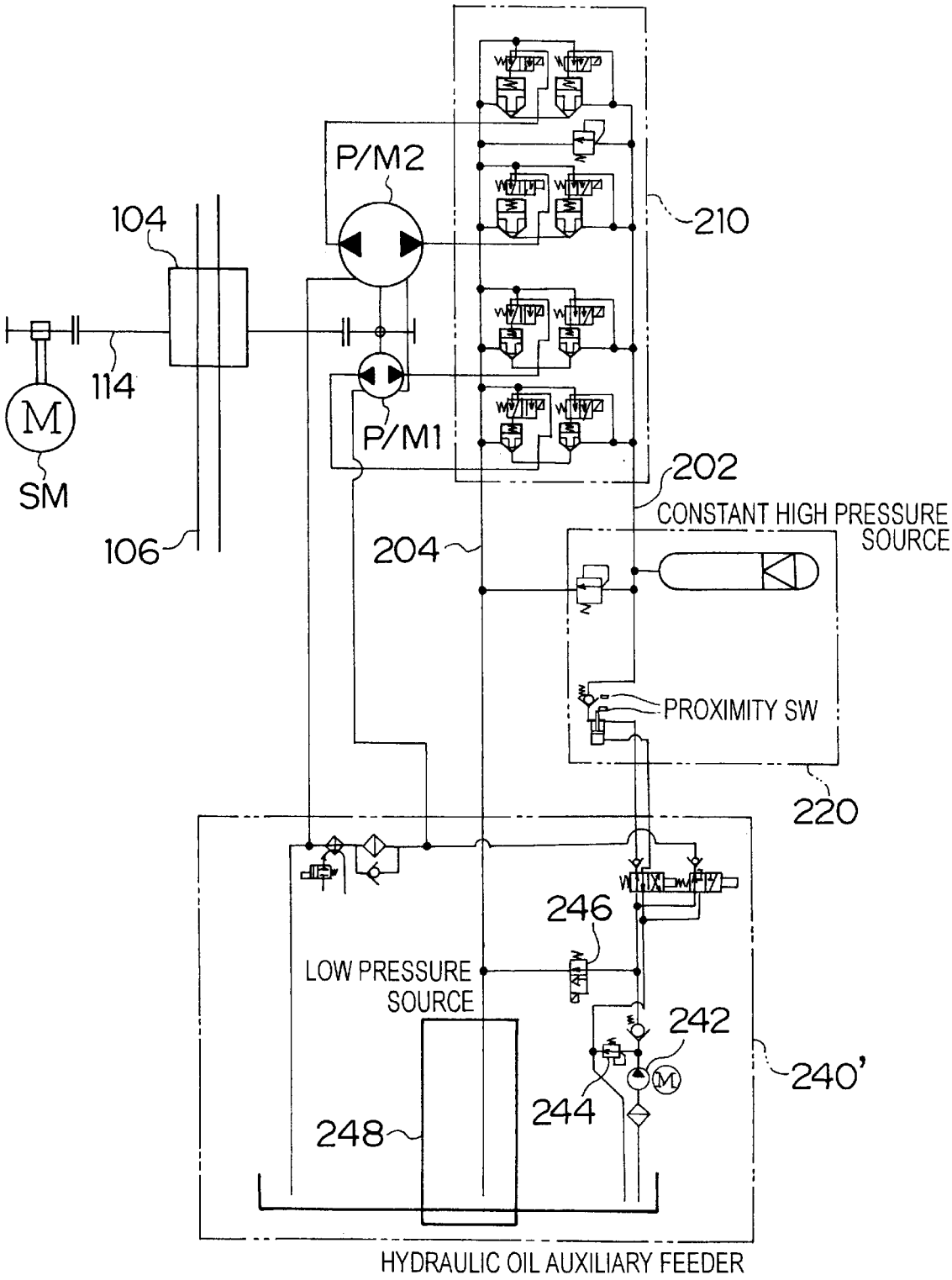
FIG. 4 illustrates another embodiment of the hydraulic pump/motor drive apparatus shown in FIG. 1.

FIG. 4 illustrates another embodiment of the hydraulic pump/motor drive apparatus. The parts common to the parts in FIG. 3 will be assigned the same reference numerals and detailed explanations thereof will be omitted. As shown in FIG. 4, the hydraulic oil auxiliary feeder 240' is provided with a tank 248 and the pipe 204 on the low pressure side is connected to this tank 248. This allows the circuit pressure on the low pressure side to be always kept at a quasi-atmospheric pressure.

Next, the combination of the electric motor SM and hydraulic pumps/motors P/M1 and P/M2 on a torque level will be explained.

<Basic Principle That Allows Combination>

Output torque $T_H$ of the hydraulic pump/motor can be expressed by the following expression:

$$T_H=k_H \cdot q \cdot (P_A-P_B) \tag{1}$$

where, $T_H$: Output torque of hydraulic pump/motor (Nm)

$k_H$: Proportional constant (Nm/Pa/cm$^3$)

q: Displacement (cm$^3$/s)

$P_A$, $P_B$: Pressure acting on both ports of hydraulic pump/motor (Pa)

In the case of normal hydraulic drive (control of amount of oil), pressures $P_A$, $P_B$ can be expressed by the following expressions:

$$P_A=\int(K(Q_A-q\omega/2\pi)/V_A)dt \tag{2}$$

$$P_B=\int(K(q\omega/2\pi-Q_B)/V_B)dt \tag{3}$$

where,

ω: Angular velocity of hydraulic pump/motor (rad/s)

K: Volume modulus of oil (Pa)

$Q_A$, $Q_B$: Amount of oil flowing into/from hydraulic P/M (cm$^3$/s)

$V_A$, $V_B$: Volume of conduit on both ports A and B of hydraulic P/M (cm$^3$)

Together with the command output (opening/closing of valve and amount of tilted rotation of pump are given), the amount of oil $Q_A$ is output. The actions of pressures $P_A$, $P_B$ are delayed due to the compression (integration operation) of the oil as expressed by expressions (2) and (3) and the response of torque $T_H$ shown in expression (1) is affected by a pressure response delay in addition to the response delay from the command (determined by opening/closing of the valve and response of tilted rotation of the pump) to the amount of oil $Q_A$ and a large response delay is produced as a whole.

That is, in the case of conventional control of an amount of oil, the response of hydraulic P/M output torque to the command is delayed a great deal.

On the other hand, output torque $T_E$ of the electric motor is expressed by the following expression:

$$T_E=K_E \cdot I \tag{4}$$

where, $T_E$: Output torque of electric motor (Nm)

$K_E$: Torque constant (Nm/A)

I: Current (A)

The response of torque $T_E$ is proportional to the response of current I. The responsivity from the command to the current (current response) is relatively good and there is a minimal response delay of the electric (servo) motor output torque to the command as a whole.

Thus, combining the torque of the hydraulic pump/motor and the torque of the electric motor in conventional hydraulic drive is substantially impossible because both torque response characteristics (dynamic characteristics) are quite different (response of the hydraulic pump/motor is slow).

In contrast to conventional hydraulic drive, the present invention constitutes a constant high pressure source using an accumulator, etc. and always (beforehand) maintains $P_A$ quasi-constant ($P_B$ is connected to the tank to be set to a quasi-atmospheric pressure or maintained at a quasi-constant low pressure using an accumulator in the same way as $P_A$) and it is thereby possible to exclude influences of compressibility of the oil which is a main cause of the torque response delay and combine with the electric motor on a torque level. That is, in expression (1), since a pressure rise is completed for $P_A$ and $P_B$, the output torque of the hydraulic pump/motor is only determined by the response of q (response of amount of tilted rotation, response of opening/closing of valve), making it possible to realize high-speed response and torque combination with the electric motor on the drive axis.

<Use of Combined Torque (Static Design)>

(1) Assisting Operation

Figure 5:
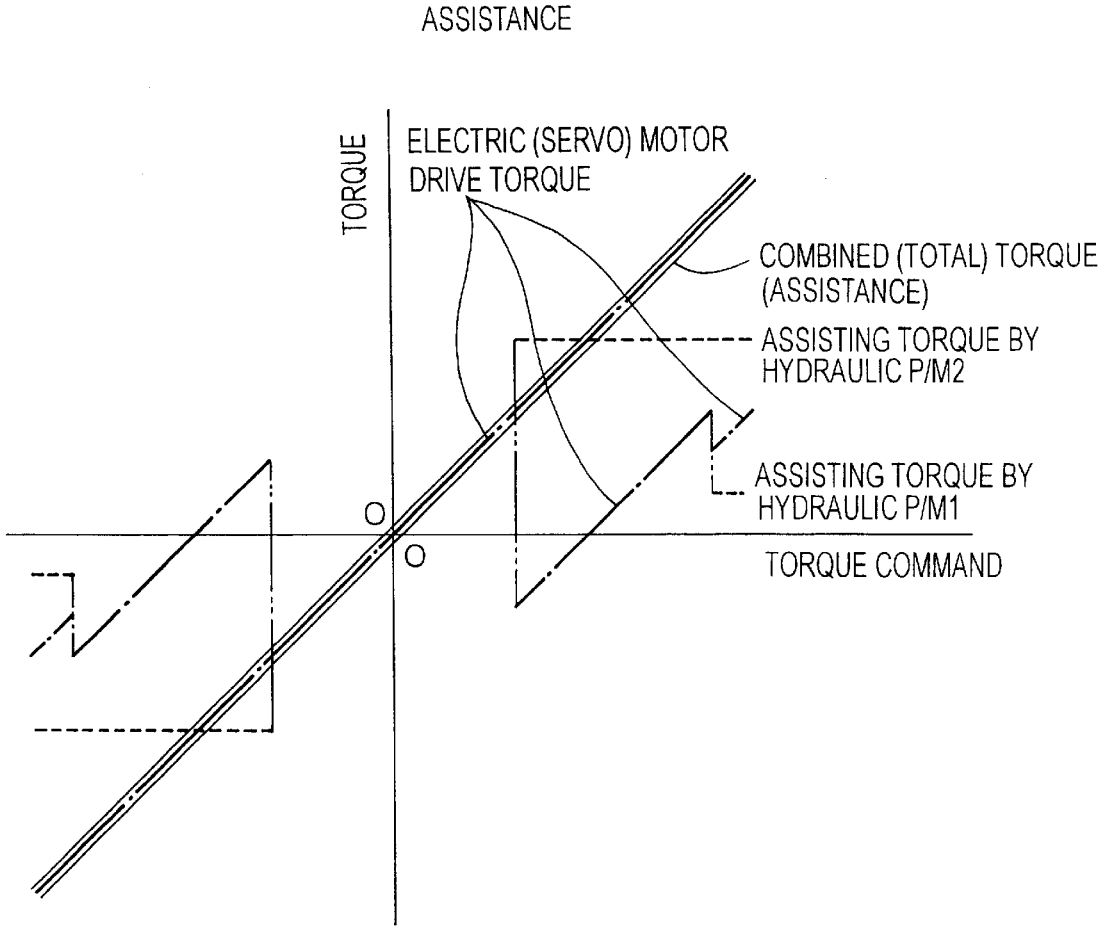
FIG. 5 is a view illustrating an assisting operation of the hydraulic pump/motor on an electric motor.

Combination aimed at assisting operation of one or a plurality of hydraulic pumps/motors for output torque of electric motor during acceleration or when large external load is acting:

As shown in FIG. 5, in response to a torque command conceived by combining the electric motor SM, hydraulic pumps/motors PM1 and PM2, the output torque of the hydraulic pumps/motors PM1 and PM2 acts according to the torque command. Here, suppose the output torque of the electric motor SM is variable linearly within a predetermined torque range in the forward and backward directions depending on the magnitude and direction of the current that flows, the hydraulic pump/motor P/M1 outputs constant torque which is smaller than the maximum output torque of the electric motor SM and the hydraulic pump/motor P/M2 outputs constant torque which is greater than the maximum output torque of the electric motor SM.

Then, when the output torque of the hydraulic pumps/motors P/M1 and P/M2 acts on the output torque of the electric motor SM, the electric motor SM must produce output proportional to the amount of calculation to control the slide operation according to the amount of slide control calculated and produces output with an offset equivalent to the output torque of the acting hydraulic pump/motor to make the combined torque variable continuously in the positive and negative directions.

When large molding load acts on the screw press 100, this can assist in complementing the torque shortage of the electric motor SM by operating the hydraulic pump/motor P/M1 and/or hydraulic pump/motor P/M2 in the same direction as that of the electric motor SM. Since a constant pressure source acts on the hydraulic pumps/motors P/M1 and P/M2, direct torque acts (responds as a torque value) on the signal output from the slide drive control apparatus 300 to the hydraulic pump/motor drive apparatus 200.

Figure 6:
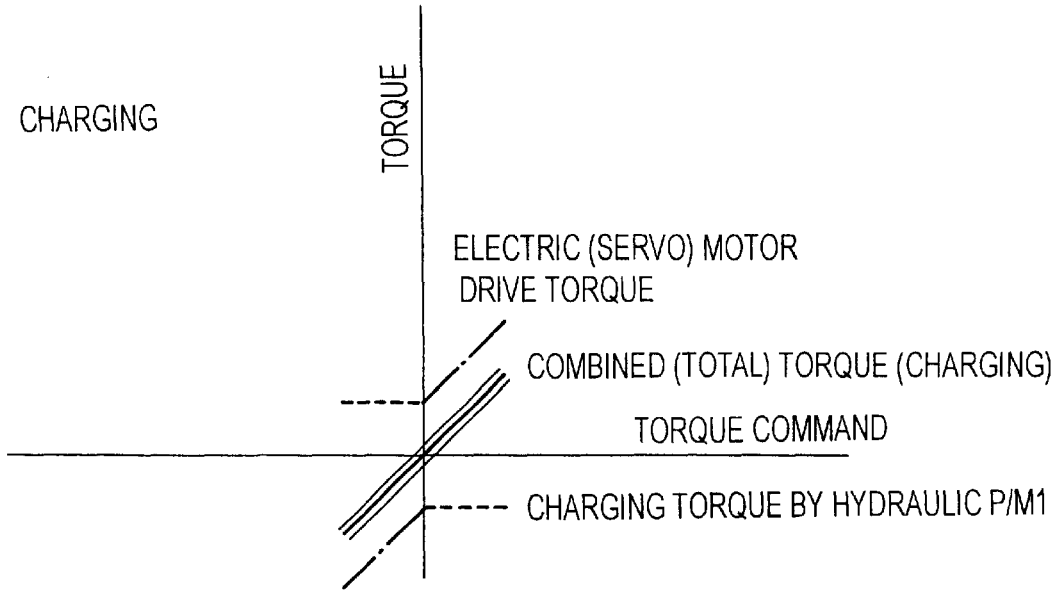
FIG. 6 is a view illustrating a charging operation of the hydraulic pump/motor on a constant high pressure source through surplus torque of the electric motor.

(2) Combination (charging) of both torques when surplus torque of electric motor SM during low load operation such as uniform motion is stored in constant high pressure source as energy of hydraulic oil:

As shown in FIG. 6, within the range in which the torque command is small, the load is small relative to the rated torque of the electric motor SM and thus the electric motor SM has an adequate margin of power. In this case, the hydraulic pump/motor P/M1 is operated in the direction opposite (pump operating direction) to the operating direction (torque operating direction of electric motor SM) and as a result, the surplus torque of the electric motor SM is stored (charged) in the accumulator 222 of the constant high pressure source 220 as energy of the hydraulic oil.

On the other hand, the electric motor SM needs to output torque in proportion to the amount of calculation in order to control the slide operation according to the amount of slide control calculated, outputs torque with an offset equivalent to the torque of the hydraulic pump/motor and allows the combined torque to act continuously in the positive and negative directions.

Figure 7:
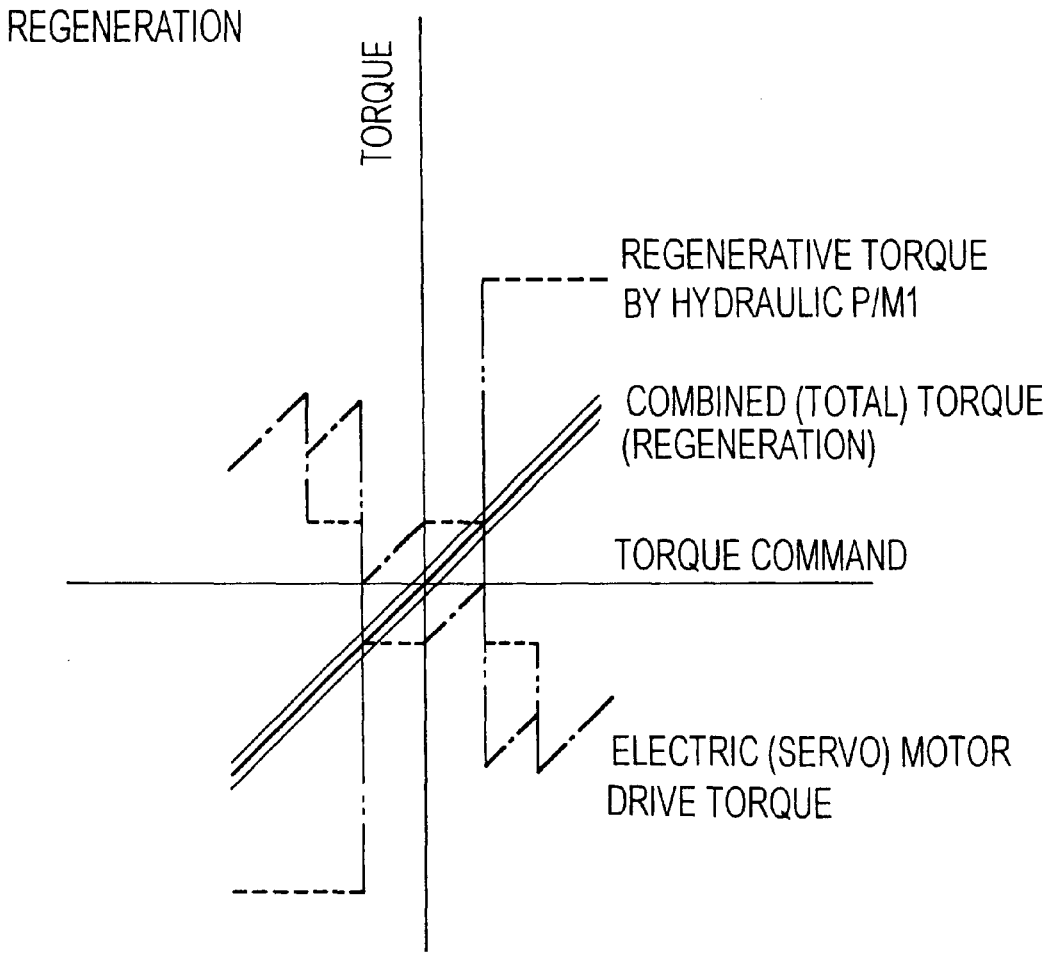
FIG. 7 is a view illustrating a regeneration operation for regenerating a kinetic energy retained by a slide into the constant high pressure source during a decelerating (braking) operation.

(3) Combination (regeneration) when regenerating kinetic energy of slide into constant high pressure source and letting braking torque act as its regenerative reaction force during decelerating (braking) operation:

During a decelerating operation of the screw press 100, depending on the value of the load acting from outside as shown in FIG. 7 (excluding the case where externally acting load carries braking torque), a plurality of hydraulic pumps/motors is operated in the direction opposite to the operation direction (in braking direction) (in pump operating direction) according to the magnitude of the braking torque.

On the other hand, the electric motor SM needs to output torque in proportion to the amount of calculation in order to control the slide operation according to the amount of slide control calculated during deceleration, too, outputs torque with an offset equivalent to the torque of the hydraulic pump/motor and allows the combined torque to act continuously in the positive and negative directions.

At this time, if the hydraulic pump/motor is of a fixed capacity type, it is necessary to operate a hydraulic pump/motor with larger torque than required braking torque (in a form similar to an absolute value), the output torque of the electric motor SM necessarily acts in the direction opposite (acceleration direction) to the braking direction to keep balance. This makes it possible to store energy output by the electric motor (torque) for balance adjustment simultaneously with the regeneration of kinetic energy of the slide (Turbo charging).

<Use of Combined Torque (Dynamic Design)>

Figure 8:
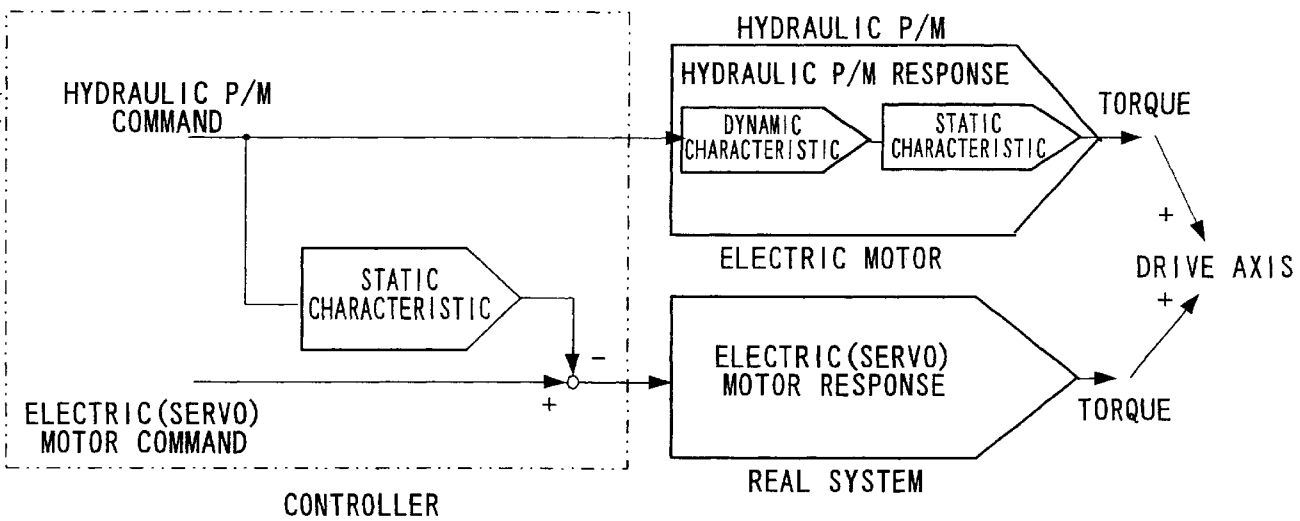
FIGS. 8(A) and 8(B) are schematic views of a controller that outputs a command to the electric motor and the hydraulic pump/motor.
Figure 8:
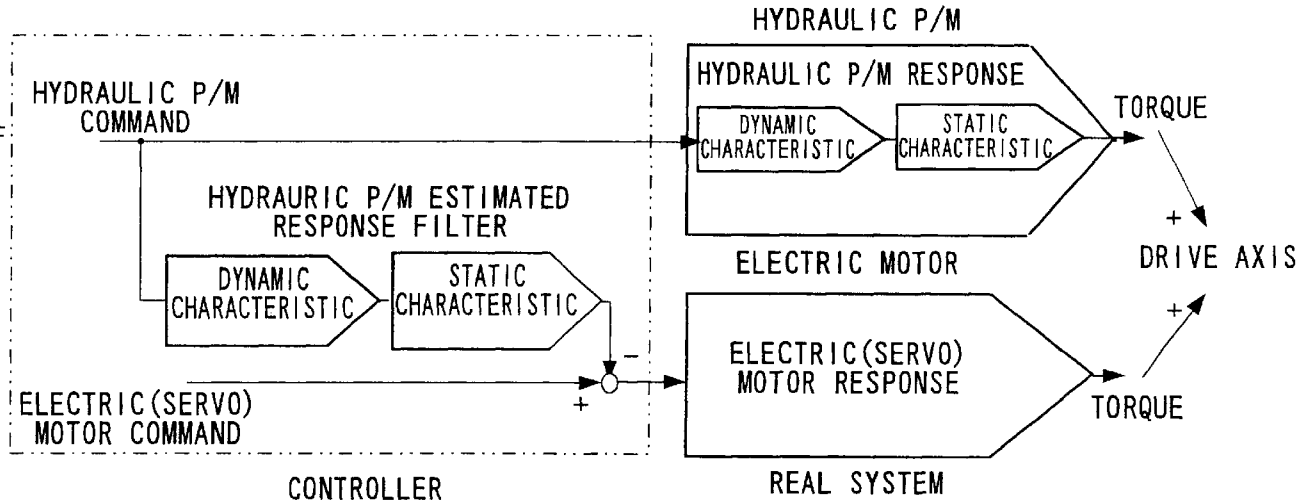

FIGS. 8(A) and 8(B) are schematic views of a controller that outputs a command to the electric motor and hydraulic pump/motor, respectively.

When the torque of the electric motor SM is combined with the torque of the hydraulic pump/motor P/M for the purpose of storage of surplus torque and regeneration of kinetic energy as described above, FIG. 8(A) shows a controller when the responsivity of the hydraulic pump/motor is not considered and FIG. 8(B) shows a controller when the responsivity of the hydraulic pump/motor is considered.

The electric motor SM is different from the hydraulic pump/motor P/M in responsivity and the controller shown in FIG. 8(B) is designed so that the electric motor SM with high responsivity is adjusted to the response of the hydraulic pump/motor P/M in a transitory action during combination in order to realize dynamic matching. That is, the controller is designed to drive the electric motor SM with the torque responsivity of the hydraulic pump/motor P/M (offset component equivalent to torque of hydraulic pump/motor P/M).

FIGS. 9(A) and 9(B) are graphs showing a relationship between the torque of the electric motor SM and the torque of hydraulic pump/motor and combined torque that combines these torques.

FIG. 9(A) shows a graph in the case where a torque command is changed continuously and the torque of the electric motor is controlled without considering the responsivity of the hydraulic pump/motor P/M, and in this case, the combined torque is continuous near ON/OFF points of the hydraulic pump/motor. On the other hand, FIG. 9(B) shows a graph in the case where a torque command is changed continuously and the torque of the electric motor is controlled considering the responsivity of the hydraulic pump/motor P/M, and in this case, the combined torque changes continuously irrespective of ON/OFF of the hydraulic pump/motor.

Next, the slide drive control apparatus 300 shown in FIG. 1 will be explained.

This slide drive control apparatus 300 is mainly constructed of a slide position controller 310, a control torque estimation calculator 320, an external load estimation calculator 330, an auxiliary hydraulic oil supply calculator 340, a hydraulic pump/motor controller 350 and an electric motor combination controller 360.

The slide position controller 310 of the slide drive control apparatus 300 is given not only a slide position detection signal from the slide position detector 140 but also a drive axis angular velocity signal from drive axis angular velocity detector 142. Furthermore, the external load estimation calculator 330 of the slide drive control apparatus 300 is given not only a drive axis angular velocity detection signal but also a torque (current) detection signal from the torque detector 144 that detects torque (current) of the electric motor SM and further a pressure 1A signal, pressure 1B signal, pressure 2A signal and pressure 2B signal from pressure sensors PS1A, PS1B, PS2A and PS2B that detect pressures at port A and port B of the hydraulic pumps/motors P/M1 and P/M2, respectively.

On the other hand, the hydraulic pump/motor controller 350 outputs hydraulic P/M control command signals to turn ON/OFF eight electromagnetic switching valves 1RH, 1RL, 1LH, 1LL, 2RH, 2RL, 2LH and 2LL (see FIG. 3) of the hydraulic oil switching control section 210 and the electric motor combination controller 360 of the slide drive control apparatus 300 outputs an electric motor command signal to the electric motor SM via a servo amplifier 148. The auxiliary hydraulic oil supply calculator 340 of the slide drive control apparatus 300 outputs an auxiliary hydraulic oil supply command signal to the hydraulic oil auxiliary feeder 240 so that the pressure on the high pressure side of the accumulator 222 of the constant high pressure source 220 is kept to a quasi-constant high pressure according to the detection signal from the pressure sensor PS as shown above.

Figure 10:
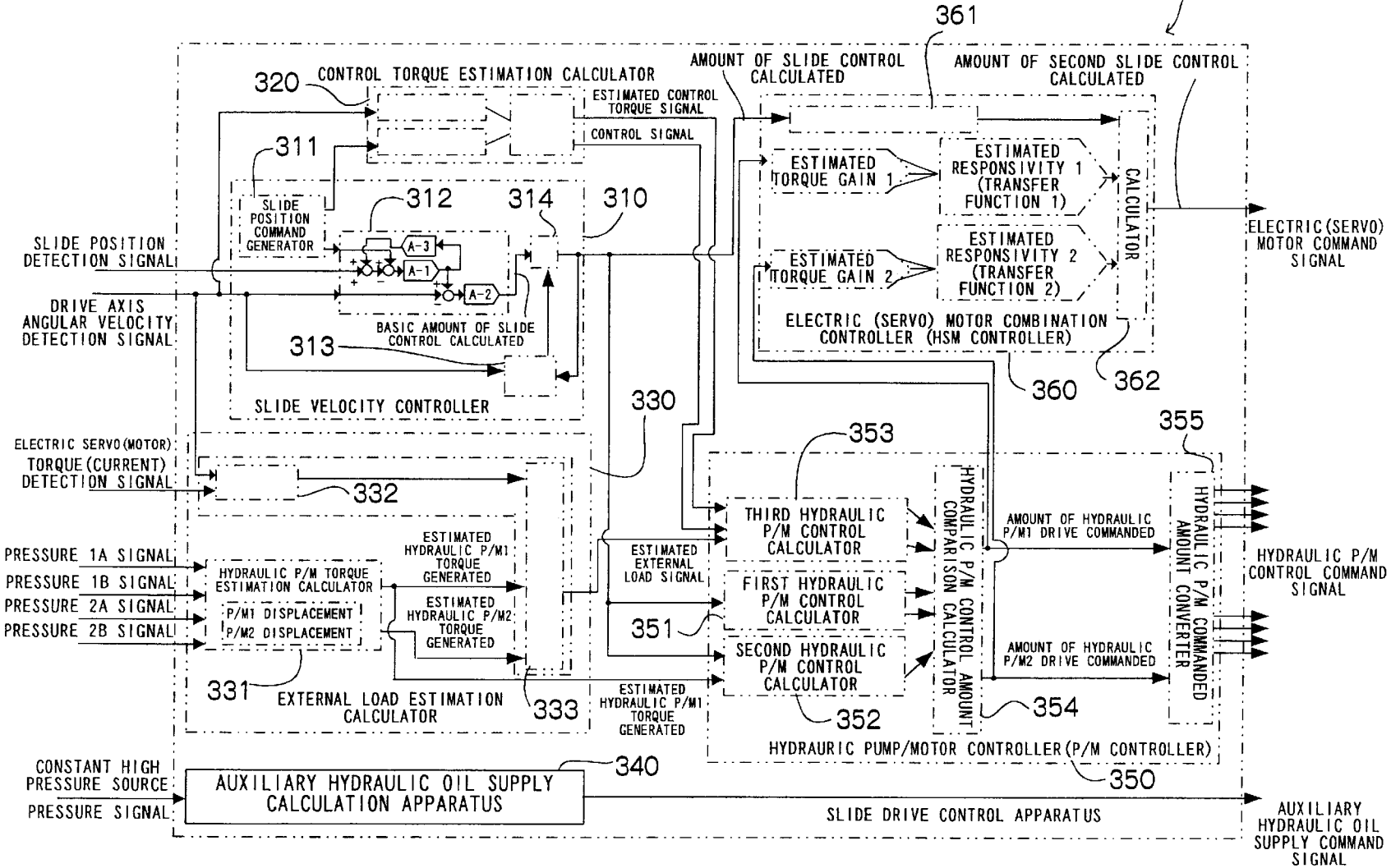
FIG. 10 is a block diagram showing details of the slide drive control apparatus shown in FIG. 1.

FIG. 10 is a block diagram showing details of the slide drive control apparatus 300.

As shown in FIG. 10, the slide position controller 310 of the slide drive control apparatus 300 is constructed of a slide position command generator 311, a first controller 312, a second controller 313 and a third controller 314. The slide position command generator 311 outputs an amount of slide position commanded indicating the target position every moment of the slide 102 to the first controller 312. The first controller 312 is given a slide position detection signal and drive axis angular velocity detection signal and the first controller 312 performs position closed-loop (feedback) control according to these signals. In addition to position feedback control, the first controller 312 also performs closed-loop control compensation (minor feedback) of the angular velocity to improve the phase characteristic, applies PID control compensation or phase compensation to the respective loops using compensation circuits A-1 and A-2, also performs feed-forward compensation to improve the closed-loop characteristic using compensation circuit A-3 and outputs the basic amount of slide control calculated.

Instead of the slide position command generator 311, it is also possible to use the drive axis angle command generator that generates an amount of drive axis angle commanded and in this case, a drive axis angle detector is provided to detect the angle of the drive axis instead of the slide position detector 140.

On the other hand, the second controller 313 estimates molding torque and an amount of disturbance such as friction from the drive axis angular velocity detection signal and the amount of slide control calculated, calculates an amount of correction and outputs this to the third controller 314. The third controller 314 adds up the basic amount of slide control calculated and the amount of correction and outputs the addition result as the amount of slide control calculated so that the slide position signal follows the amount of slide position commanded with high response and high accuracy as a whole.

Since this amount of slide control calculated is proportional to the output torque of the combination actuator designed by substantially combining the respective torques of the electric motor and the hydraulic pump/motor, the electric motor and the hydraulic pump/motor are controlled according to this amount of slide control calculated. By the way, the second controller 313 and the third controller 314 are not indispensable conditions and these are only typical examples of internal calculations of the slide position controller 310. Furthermore, it is also possible to detect the velocity of the slide 102 and use this slide velocity instead of the drive axis angular velocity.

The braking torque estimation calculator 320 is given a drive axis angular velocity detection signal and the braking torque estimation calculator 320 estimates negative acceleration assuming that the operating direction is positive from the velocity direction and an (incomplete) differential processing signal of the velocity according to the drive axis angular velocity detection signal and estimates/calculates braking torque from this negative acceleration. Or the braking torque estimation calculator 320 is given an amount of slide position commanded and the braking torque estimation calculator 320 gives the amount of commanded to a simulator (model ranging from a command including static characteristic or dynamic characteristic to the slide position) of the slide drive system which is pre-configured in the calculator according to the amount of slide position commanded and extracts and calculates braking torque which is an intermediate parameter of the simulator.

The external load estimation calculator 330 is constructed of a first calculator 331, a second calculator 332 and a third calculator 333. The first calculator 331 is given a pressure 1A signal, pressure 1B signal, pressure 2A signal and pressure 2B signal acting on both ports of the hydraulic pumps/motors P/M1 and P/M2 from the pressure sensors PS1A, PS1B, PS2A and PS2B.

This first calculator 331 estimates torque generated from the hydraulic pumps/motors P/M1 and P/M2, calculates a differential pressure acting on each hydraulic pump/motor according to the pressure 1A signal, pressure 1B signal, pressure 2A signal and pressure 2B signal, estimates an amount of calculation proportional to a value obtained by multiplying the differential pressure by the displacement (displacement as a theoretical value or experimental value) of the hydraulic pump/motor as the torque of each hydraulic pump/motor and outputs signals indicating the estimated hydraulic P/M1 torque generated and the estimated hydraulic P/M2 torque generated.

The second calculator 332 is given a torque detection signal of the electric motor SM and a drive axis angular velocity detection signal and the second calculator 332 calculates the external load including the output torques of the hydraulic pumps/motors P/M1 and P/M2 according to the difference between the incomplete differential calculation processing signal of the drive axis angular velocity signal and the torque detection signal of the electric motor SM and outputs a signal indicating this calculated external load to the third calculator 333.

The other input of the third calculator 333 is given the signals indicating the estimated hydraulic P/M1 torque generated and the estimated hydraulic P/M2 torque generated from the first calculator 331. The third calculator 333 estimates the external load (acting from outside) by subtracting the estimated hydraulic P/M1 torque generated and the estimated hydraulic P/M2 torque generated from the signal indicating the external load and outputs the estimated external load signal.

The hydraulic pump/motor controller 350 is constructed of a first hydraulic P/M control calculator 351, a second hydraulic P/M control calculator 352, a third hydraulic P/M control calculator 353, a hydraulic P/M control amount comparison calculator 354 and a hydraulic P/M commanded amount converter 355.

The first hydraulic P/M control calculator 351 is given an amount of slide control calculated from the slide position controller 310. The first hydraulic P/M control calculator 351 outputs a first amount of calculation of P/M control to control the hydraulic pumps/motors P/M1 and P/M2 (for the purpose of combining (torque) with the electric motor SM=for the purpose of assistance) according to the value and range of the amount of slide control calculated.

The second hydraulic P/M control calculator 352 is given an amount of slide control calculated from the slide position controller 310 and a signal indicating the estimated hydraulic P/M1 torque generated of the hydraulic pump/motor P/M1 from the external load estimation calculator 330. This second hydraulic P/M control calculator 352 outputs a second amount of calculation of P/M control to store the hydraulic oil in the constant high pressure source by the surplus torque of the electric motor SM according to the amount of calculation according to the sum of the amount of slide control calculated and the signal indicating the estimated hydraulic P/M1 torque generated.

The third hydraulic P/M control calculator 353 is given an estimated braking torque signal from the braking torque estimation calculator 320 and an estimated external load signal from the external load estimation calculator 330. This third hydraulic P/M control calculator 353 outputs a third amount of calculation of P/M control intended to regenerate the kinetic energy of the slide 102 into the constant high pressure source as energy of hydraulic oil during braking according to the value and range of the amount of calculation according to the sum or difference between the estimated braking torque signal and estimated external load signal.

The hydraulic P/M control amount comparison calculator 354 is given a first, second and third amounts of calculation of P/M control from the first, second and third hydraulic P/M control calculators. The hydraulic P/M control amount comparison calculator 354 performs comparison and calculation of priority order, etc. on the first, second and third amounts of calculation of P/M control and outputs the amount of hydraulic P/M1 drive commanded and the amount of hydraulic P/M2 drive commanded corresponding to the hydraulic pumps/motors P/M1 and P/M2 according to these comparison calculations.

The hydraulic P/M commanded amount converter 355 outputs a hydraulic P/M control command signal to turn ON/OFF eight electromagnetic switching valves 1RH, 1RL, 1LH, 1LL, 2RH, 2RL, 2LH and 2LL (see FIG. 3) of the hydraulic oil switching control section 210 according to the amount of hydraulic P/M1 drive commanded and the amount of hydraulic P/M2 drive commanded input from the hydraulic P/M control amount comparison calculator 354.

That is, the amount of hydraulic P/M1 drive commanded and the amount of hydraulic P/M2 drive commanded output from the hydraulic P/M control amount comparison calculator 354 are amounts of commanded indicating no load (0), torque output directions +1 (R direction) and −1 (L direction) respectively and the hydraulic P/M commanded amount converter 355 generates and outputs a command signal (group) of the switching valve corresponding to the output directions, etc. of the hydraulic pumps/motors P/M1 and P/M2.

For example, when the hydraulic P/M control amount comparison calculator 354 outputs the amount of hydraulic P/M1 drive commanded which causes the hydraulic pump/motor P/M1 to output torque in the +1 (R) direction, the hydraulic P/M commanded amount converter 355 excites (ON) the electromagnetic switching valve 1RL (meaning low pressure side switching valve of the hydraulic pump/motor P/M1 on the clockwise rotation side) and the electromagnetic switching valve 1RH. Likewise, when the hydraulic P/M control amount comparison calculator 354 outputs the amount of hydraulic P/M2 drive commanded which causes the hydraulic pump/motor P/M2 to output torque in the −1 (L) direction, the hydraulic P/M commanded amount converter 355 excites (ON) the electromagnetic switching valve 2LH (meaning high pressure side switching valve of the hydraulic pump/motor P/M2 on the counterclockwise rotation side).

However, when hydraulic pumps/motors P/M1 and P/M2 are set to torque 0, only RL or LL side switching valve may be turned ON/OFF depending on the rotation direction of the drive axis to prevent cavitation (air suction).

Now, when the hydraulic pump/motor P/M1 is driven in +1 (R) direction, the hydraulic P/M commanded amount converter 355 excites the electromagnetic switching valve 1RH as described above. This causes the pilot pressure of the 1RH logic valve to be released from the constant high pressure source 220 to the low pressure source 230 as shown in FIG. 3 and the 1RH logic valve is opened. At the same time (strictly speaking, a slight time difference may be provided (1RL first) to secure stable operation) when the electromagnetic switching valve 1RL is excited, the pilot pressure of the 1RL logic valve is connected from the low pressure source 230 to the constant high pressure source 220 via the main port of the 1RH logic valve and the main port of the 1RH logic valve is closed. This combination operation causes the port A of the hydraulic pump/motor P/M1 to be connected to the constant high pressure source 220 (while port B remains connected to the low pressure source because both the electromagnetic switching valves 1LH and 1LL are not excited) and the hydraulic pump/motor P/M1 outputs torque in the +1 (R) direction.

In FIG. 10, the electric motor combination controller 360 is given an amount of slide control calculated from the slide position controller 310, and an amount of hydraulic P/M1 drive commanded (−1, 0 or +1) and an amount of hydraulic P/M2 drive commanded (−1, 0 or +1) from the hydraulic pump/motor controller 350.

The electric motor combination controller 360 estimates and calculates a torque response value (including dynamic characteristic) of the hydraulic pump/motor P/M1 with respect to the input amount of hydraulic P/M1 drive commanded according to the estimated torque gain 1 and estimated responsivity 1 and likewise estimates and calculates a torque response value (including dynamic characteristic) of the hydraulic pump/motor P/M2 with respect to the input amount of hydraulic P/M2 drive commanded according to the estimated torque gain 2 and estimated responsivity 2.

The calculator 362 of the electric motor combination controller 360 is given the amount of slide control calculated via a compensation element 361 and the torque response values calculated above of the hydraulic pumps/motors P/M1 and P/M2. The calculator 362 subtracts the torque response value from the amount of slide control calculated to generate a second amount of slide control calculated (electric motor command signal output to the electric motor SM). By driving the electric motor SM according to this electric motor command signal, it is possible to combine output torques of the electric motor SM and hydraulic pumps/motors P/M1 and P/M2. That is, the amount of slide control calculated is an amount of command that drives the electric motor SM and hydraulic pumps/motors P/M1 and P/M2 combined together and the electric motor combination controller 360 gets information on the command for driving the hydraulic pumps/motors P/M1 and P/M2 (amount of hydraulic P/M1 drive commanded, amount of hydraulic P/M2 drive commanded) fed back to the control on the electric motor SM side.

Next, an operation of the press machine slide drive apparatus in the above configuration will be explained.

<Description of State Waveform>

Figure 11:
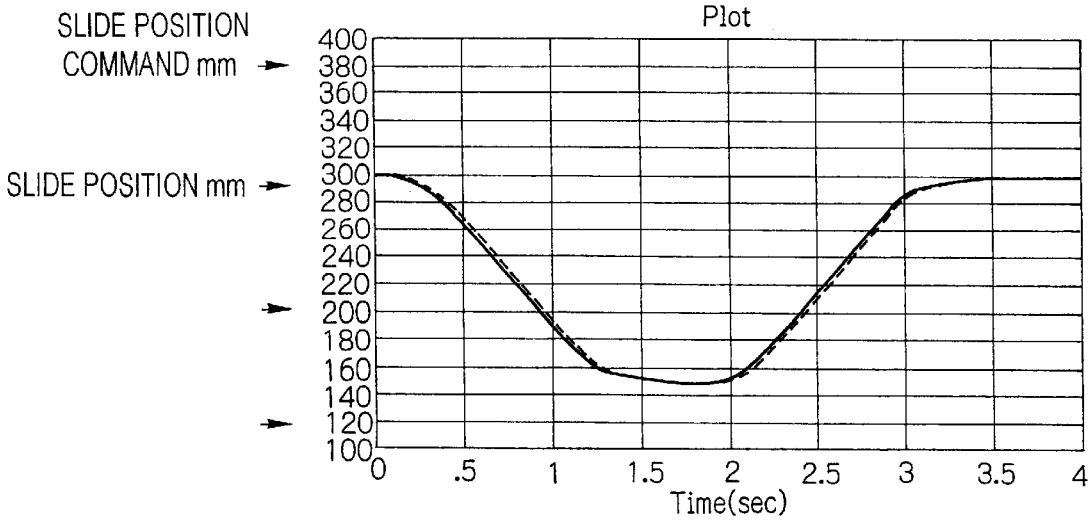
FIG. 11 is a graph showing a relationship between a slide position command and a slide position of the slide controlled according to the slide position command.

As shown in FIG. 11, control is performed so that the slide position follows the slide position command every moment generated from the slide position command generator 311. The delayed curve on the time scale in FIG. 11 indicates the slide position. This embodiment assumes that the command for the upper limit position of the slide is 300 mm and the command for the lower limit position is 150 mm. Here, suppose the upward direction is the positive direction.

Figure 12:
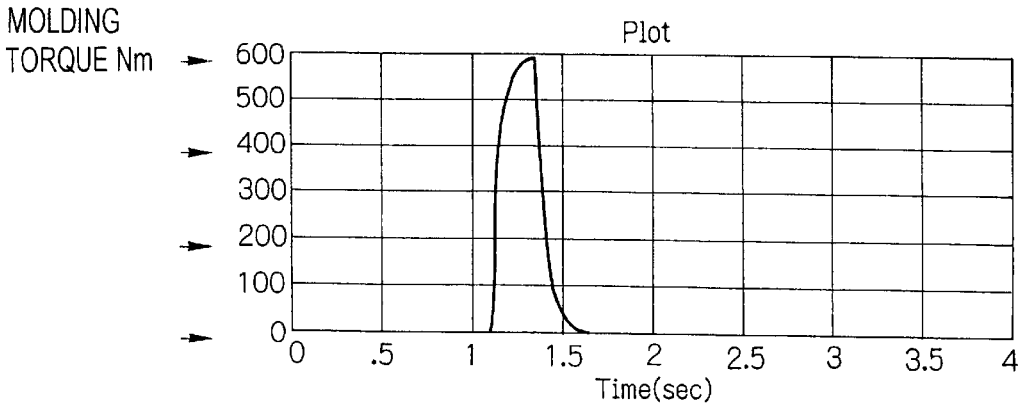
FIG. 12 is a graph showing molding torque acting on the screw press.

As shown in FIG. 11, a slide position command is generated according to the time integration of a slide velocity of 150 mm/s. In the section between slide positions 180 mm and 152 mm, molding torque caused by the molding force load acts on the drive axis as shown in FIG. 12.

Figure 13:
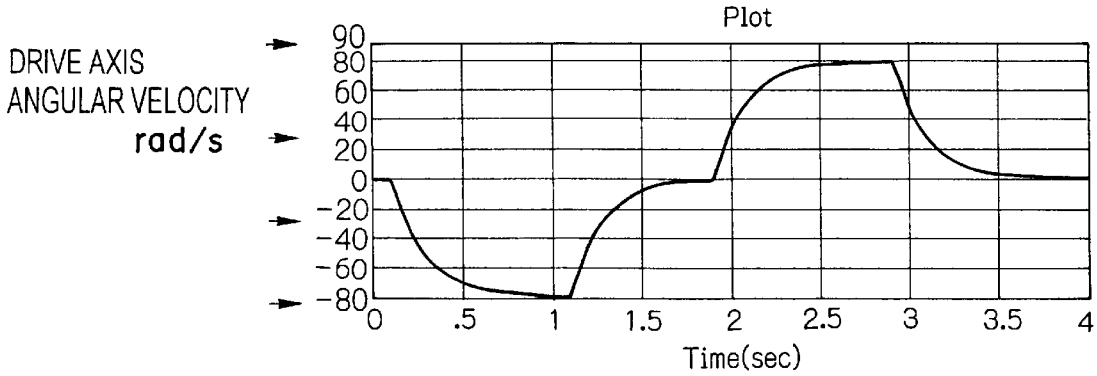
FIG. 13 is a graph showing how a drive axis angular velocity of the screw press changes.
Figure 14:
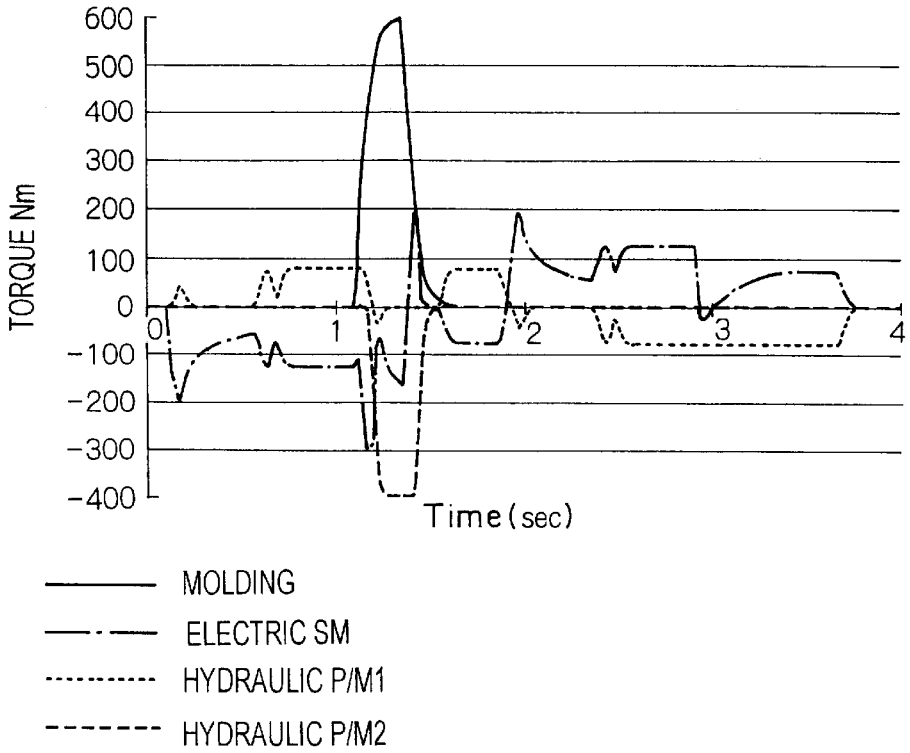
FIG. 14 is a graph showing a relationship between torque of the electric motor and the hydraulic pump/motor and the molding torque.

FIG. 13 shows the drive axis angular velocity. From this it is apparent that the drive axis angular velocity shows a stable velocity curve independent of the operation of weight. FIG. 14 shows torque of the electric motor SM that acts on the slide drive axis (single-dot dashed line), torque of the hydraulic pump/motor P/M1 (dashed line), torque of the hydraulic pump/motor P/M2 (broken line) and molding torque (solid line).

Figure 15:
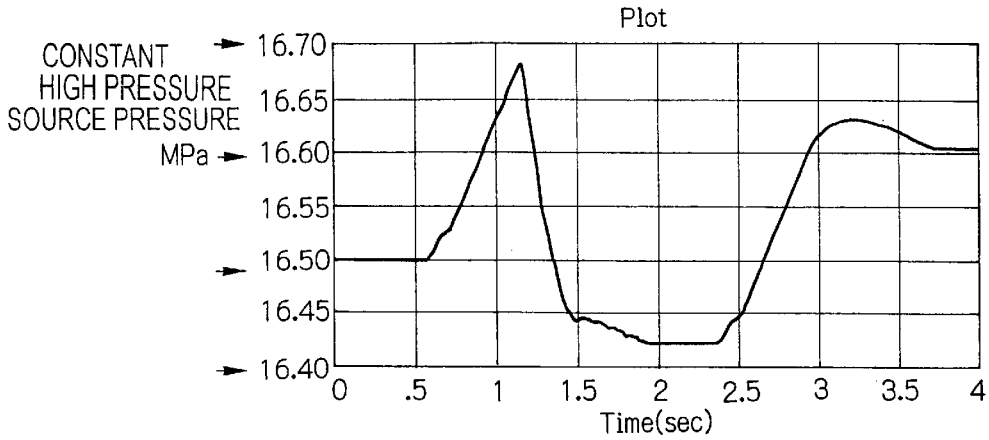
FIG. 15 is a graph showing how the pressure of the constant high pressure source changes.
Figure 16:
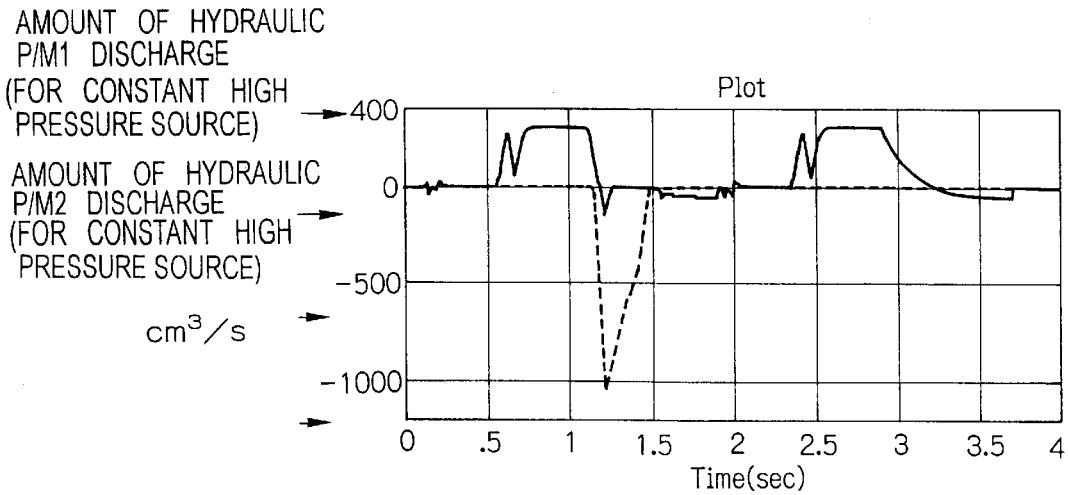
FIG. 16 illustrates how the amount of oil flowing between the hydraulic pump/motor and the constant high pressure source.

FIG. 15 shows pressure variations of the constant high pressure source 220. FIG. 16 illustrates the amount of oil flowing between the hydraulic pumps/motors PM/1 and P/M2 and constant high pressure source 220 (positive direction: amount of oil flowing into the constant high pressure source 220, negative direction: amount of oil flowing out of the constant high pressure source 220). In FIG. 16, the solid line shows the amount of discharge of the hydraulic pump/motor PM/1 and the broken line shows the amount of discharge of the hydraulic pump/motor PM/2.

<Description of Action>

<During Slide Acceleration>

The following is an explanation of the action given in chronological order. As shown in FIG. 11, a position command value generated from the slide position command generator 311 is generated from 0.1 s and the amounts of commanded of the electric motor SM and hydraulic pumps/motors P/M1 and P/M2 are calculated according to the position command values and various input signals, an electric motor command signal is output from the electric motor combination controller 360 in the slide drive control apparatus 300 and a hydraulic P/M control command signal is output from the hydraulic pump/motor controller 350.

According to FIG. 14 (each torque acting on the drive axis), the torque of the electric motor SM shows a peak of around −200 Nm as the slide is accelerated accompanying the start of the downward (negative direction) operation. This slide acceleration area is basically carried by the electric motor SM as shown in this example, but in the case of greater acceleration, the slide acceleration area is also carried by the hydraulic pump/motor P/M2 with a relatively large capacity or hydraulic pump/motor P/M1 with a relatively small capacity (assisting action; when slide velocity is high, see FIG. 17 and FIG. 18).

<Charging During Slide Uniform Motion>

Then, as shown in FIG. 13, as the drive axis angular velocity is settled (150 mm/s) around 0.6 s, the torque of the electric motor SM shown in FIG. 14 reduces (as the acceleration torque decreases). At this time, the torque of the electric motor SM falls short of the rated output, which produces a margin of load and this surplus torque activates (operates the pump) the hydraulic pump/motor P/M1 with a smaller capacity in the direction opposite to the direction of the electric motor SM to store the hydraulic oil in the constant high pressure source 220. This operation activates the torque of the hydraulic pump/motor P/M1 in the positive direction in FIG. 13, increases the pressure of the constant high pressure source 220 as a result of storing the hydraulic oil in FIG. 15 and flows the P/M1 discharge oil into the constant high pressure source 220 in FIG. 16.

<Assisting Molding Force Load>

As shown in FIG. 12, press molding is carried out in a range 1.1 s to 1.35 s which causes molding torque to act on the drive axis. The molding torque acting at this time is approximately 600 Nm and the maximum output torque of the electric motor SM is approximately 300 Nm, and therefore the molding force cannot be carried by the power of the electric motor SM alone and as shown in FIG. 14, the hydraulic pump/motor P/M2 with a larger capacity operates in the same direction as that of the electric motor SM. FIG. 15 shows that the hydraulic oil is consumed from the constant high pressure source 220 accompanying this operation. At this time (in this example), the hydraulic pump/motor P/M is of a fixed capacity (displacement) type and connected to the constant high pressure source 220 as shown in this example, and therefore almost constant (absolute value) torque is output. Therefore, in order to always secure balance between the torques acting on the drive axis including dynamic operation, the electric motor SM increases or decreases the output torque so as to adjust the balance. (In the process of molding torque operation, the pressure temporarily decreases at a certain molding torque value and increases again to maintain balance of total torque.)

<Regeneration During Slide Deceleration>

As shown in FIG. 13, in a range 1.15 s to 1.9 s, as is also apparent from the drive axis angular velocity shown in the same figure, while the molding force acts in the first half stage, the slide shows a decelerating state. At this time, the braking torque necessary for deceleration acting in the reverse operating direction (positive direction) is carried by part of the molding torque while the molding force is acting (in other words, the molding force is balancing with the sum of the torques of the electric motor SM and hydraulic pump/motor P/M and inertia torque (torque with the same magnitude as the braking torque and acting in the opposite direction)), the hydraulic pump/motor P/M acts in the direction opposite to the operating direction (pump operation) while the molding force is not acting in the last-half stage (in this example, the hydraulic pump/motor P/M1 acts in the reverse operating direction because the braking torque is relatively small) generating braking torque (see FIG. 14) and at the same time regenerating the kinetic energy of the slide into the high pressure source as energy of the hydraulic oil. At this time, the torque of the electric motor SM acts in the negative direction to maintain the balance with the torque of the hydraulic pump/motor P/M1 and the braking torque and this component of energy as well as the kinetic energy component are stored in the constant high pressure source 220 (turbo charging action).

<Charging Regeneration During Slide Rise>

As shown in FIG. 11, the process after 1.9 s is a slide ascending process, which changes in stages of acceleration, uniform motion and deceleration as in the case of the descending process. At this time, hydraulic oil storing operation is carried out on the constant high pressure source 220 during low load operation as in the case of the descending process. During deceleration, however, the molding force does not act unlike the descending process, and therefore the total amount of kinetic energy of the slide is regenerated into the constant high pressure source 220 (this is clear because positive (in the acceleration direction) torque acts on the electric motor SM all the time). In this case, the velocity is small (small deceleration level, small deceleration torque) as in the case of the ascending process, and therefore, only the hydraulic pump/motor P/M1 with a small capacity acts.

<When Slide Velocity is High>

Figure 17:
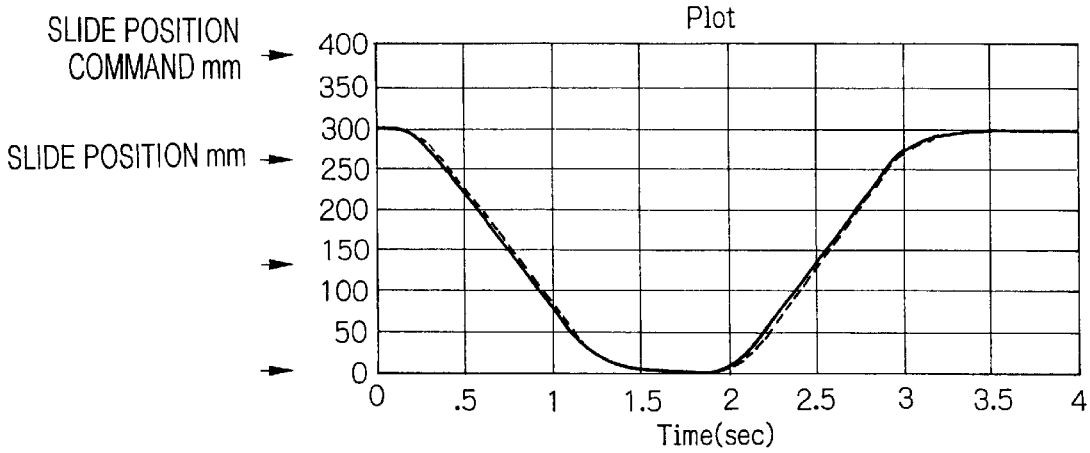
FIG. 17 is a graph showing a relationship between another slide position command and the slide position of the slide controlled according to the slide position command.
Figure 18:
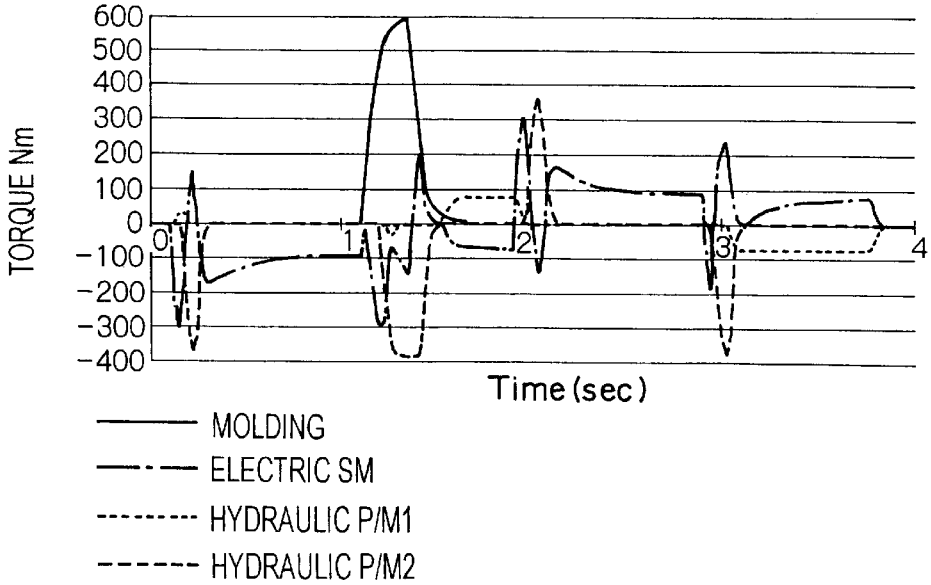
FIG. 18 is a graph showing a relationship between torque of the electric motor and the hydraulic pump/motor and molding torque.
Figure 19:
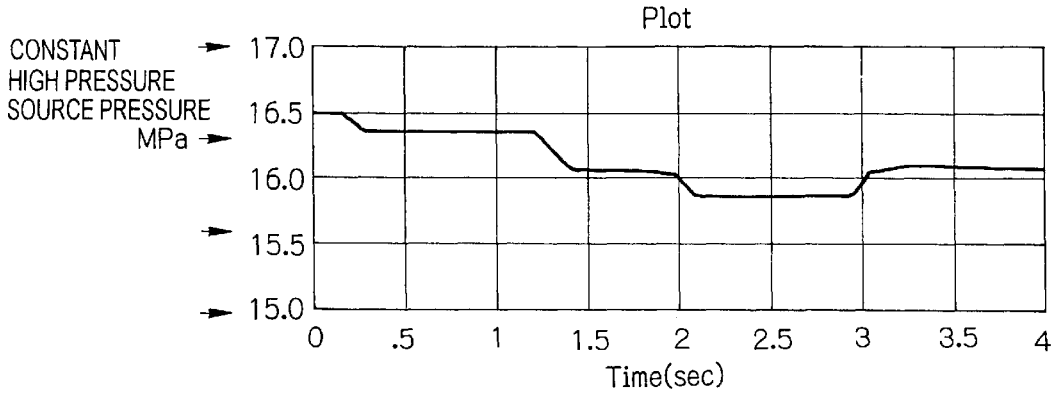
FIG. 19 is a graph showing how the pressure of the constant high pressure source changes.

FIG. 17 to FIG. 19 show a slide position command and position, torque acting on the drive axis and state waveform of the constant high pressure source pressure in a case where control is performed according to a position command equivalent to a slide velocity of 300 mm/s. When compared to the case of 150 mm/s shown in FIG. 11 to FIG. 16, in the slide acceleration process around 0.3 s and around 2 s, the hydraulic pump/motor P/M2 with a relatively large capacity with respect to the torque of the electric motor SM acts as torque assistance. This is because torque assistance is required as the acceleration torque increases. Furthermore, in the braking process during an ascent around 3 s, the hydraulic pump/motor P/M2 acts (pump operation) as the braking torque increases and regenerates kinetic energy into the constant high pressure source 220 as energy of the hydraulic oil.

<Action of Auxiliary Hydraulic Oil Supply Calculator>

The pressure of the constant high pressure source 220 shown in FIG. 15 after a one-cycle operation of the screw press 100 is completed is higher than before the one-cycle operation is started due to the charging and regeneration operations of the hydraulic pump/motor. This means that the supply of the hydraulic oil by the auxiliary hydraulic oil supply calculator 340 is not necessary. On the other hand, the pressure of the constant high pressure source 220 after a one-cycle operation is completed is lower than before the one-cycle operation is started. This requires a supply of the hydraulic oil by the auxiliary hydraulic oil supply calculator 340 equivalent to the pressure drop of the constant high pressure source 220.

<Complementary Description of Operation of Slide Drive Control Apparatus>

The slide position controller 310 in the slide drive control apparatus 300 generates a slide position command, is fed a slide position signal and drive axis angular velocity signal, starts various compensation calculations such as so-called position/velocity feedback compensation, PID compensation, phase compensation, disturbance estimation compensation and feed-forward compensation and generates and outputs an amount of slide control calculated.

The braking torque estimation calculator 320 is fed a slide position command or drive axis angular velocity signal and generates and outputs a signal of estimated braking torque which is equivalent to braking torque and a braking signal indicating a braking torque operation status.

The external load estimation calculator 330 is fed a drive axis angular velocity signal, an electric motor SM torque detection signal, pressure 1A signal, pressure 1B signal, pressure 2A signal and pressure 2B signal at the respective ports of the hydraulic pumps/motors P/M1 and P/M2, estimates and calculates output torques of the hydraulic pumps/motors P/M1 and P/M2 and molding torque, etc. accompanying the molding force action and outputs an estimated external load signal whose main components are the estimated hydraulic P/M1 generated torque signal and molding torque, etc.

The hydraulic pump/motor controller 350 is fed an amount of slide control calculated, estimated external load signal, estimated hydraulic P/M1 generated torque signal, estimated braking torque signal and braking signal.

The first hydraulic P/M control calculator 351 outputs a first amount of P/M control calculated for the purpose of torque assistance for the output torque of the electric motor SM to the hydraulic P/M control amount comparison calculator 354 according to the amount of slide control calculated.

The second hydraulic P/M control calculator 352 outputs a second amount of P/M control calculated to the hydraulic P/M control amount comparison calculator 354 for the purpose of determining through calculations the surplus torque of the electric motor SM from the amount of slide control calculated and the estimated hydraulic P/M1 generated torque signal and storing the drive energy of the surplus torque of the electric motor SM according to the surplus torque value in the constant high pressure source 220 as the energy of the hydraulic oil.

The third hydraulic P/M control calculator 353 outputs a third amount of P/M control calculated to the hydraulic P/M control amount comparison calculator 355 for the purpose of regenerating the kinetic energy of the slide in the constant high pressure source 220 from an estimated external load signal, estimated braking torque signal and braking signal during braking.

The hydraulic P/M control amount comparison calculator 354 outputs an amount of hydraulic P/M1 drive commanded and amount of hydraulic P/M2 drive commanded by calculating the first to third amounts of P/M control calculated with consideration given to priority order.

The hydraulic P/M commanded amount converter 355 outputs a hydraulic P/M control command signal to turn ON/OFF eight electromagnetic switching valves of the hydraulic switching control section 210 according to the amount of hydraulic P/M1 drive commanded and hydraulic P/M2 drive commanded to drive the hydraulic pumps/motors P/M1 and P/M2.

The electric motor combination controller 360 is fed an amount of slide control calculated and an amount of hydraulic P/M1 drive commanded and hydraulic P/M2 drive commanded, calculates the amount of calculation with consideration given to the hydraulic P/M estimated torque gain and estimated responsivity (transfer function) on each amount of hydraulic P/M drive commanded, and a second amount of slide control calculated from the amount of slide control calculated and outputs these amounts to the electric motor SM.

The above-described operation (state waveform) is obtained through a series of operations of the slide drive control apparatus 300.

Figure 20:
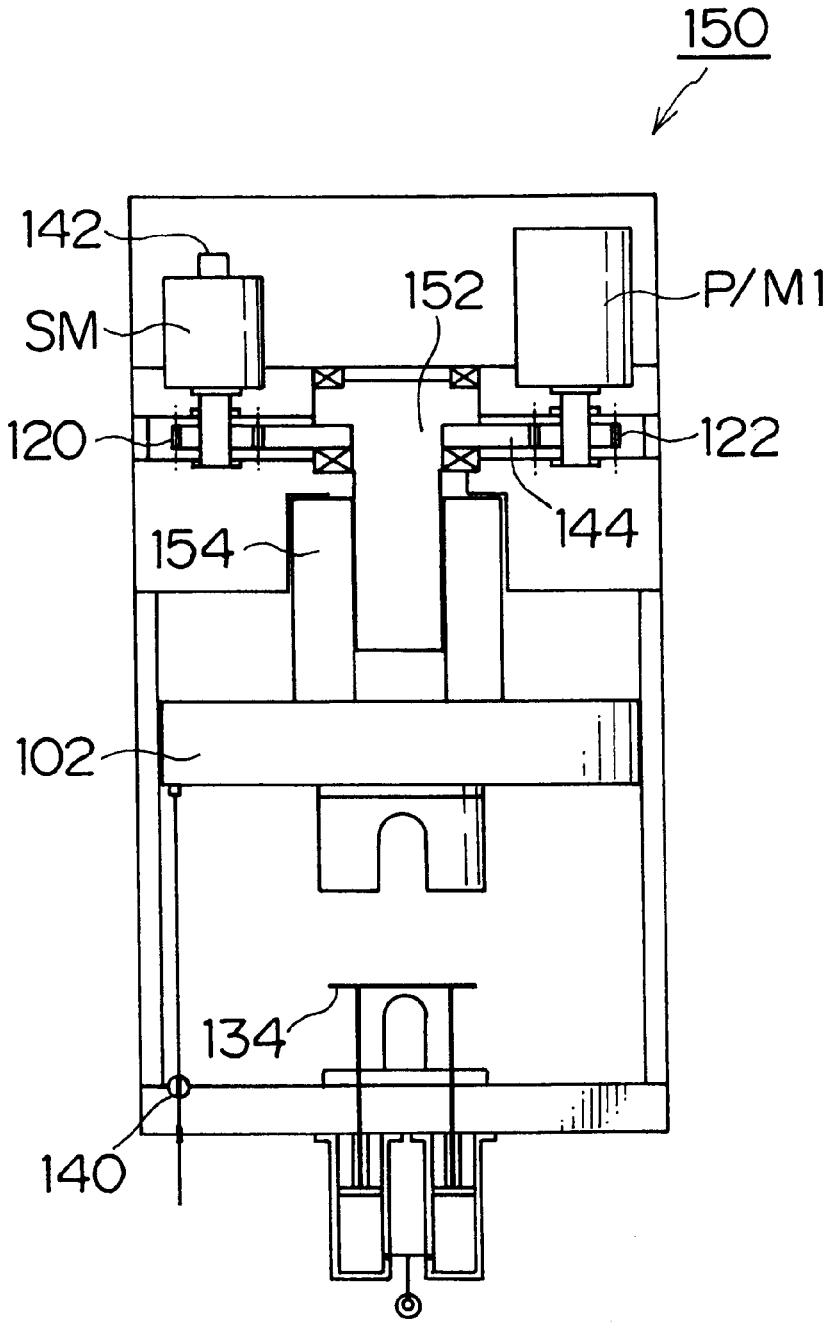
FIG. 20 illustrates a second embodiment of the press machine slide drive apparatus according to the present invention.

FIG. 20 illustrates a second embodiment of the press machine slide drive apparatus according to the present invention. The parts common to those in FIGS. 2(A) and 2(B) are assigned the same reference numerals and detailed explanations thereof will be omitted.

The screw press 150 shown in FIG. 20 has a screw mechanism different from the screw press 100 shown in FIG. 2(B) as the main drive mechanism of the slide 102. That is, while the screw press 100 shown in FIG. 2(B) is a nut rotation type screw press, the screw press 150 shown in FIG. 20 is a screw rotation type screw press.

The screw mechanism of this screw press 150 is constructed of a drive screw 152 and a driven nut 154 and the drive screw 152 is provided with a ring gear 114 integral with the drive screw 152. This ring gear 114 is engaged with a gear 120 provided for the drive axis of the electric motor SM as in the case with the screw press 100 shown in FIG. 2(B) and is also engaged with a gear 122 provided for the drive axis of two hydraulic pumps/motors P/M1, etc.

Therefore, when the drive screw 152 is rotated and driven by the electric motor SM and hydraulic pumps/motors P/M1, etc., the slide 102 ascends or descends together with the driven nut 154.

Figure 21:
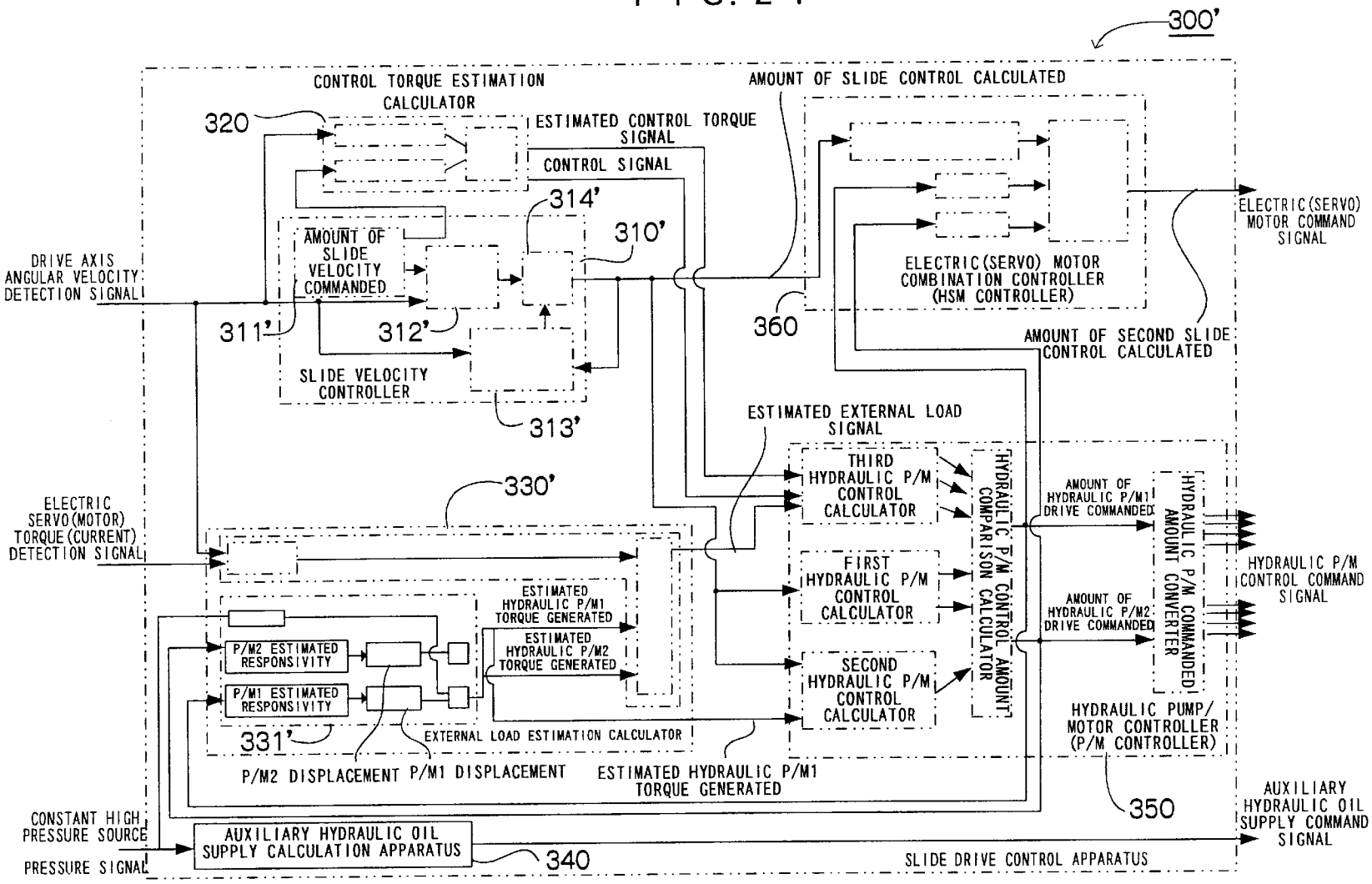
FIG. 21 illustrates a third embodiment of the press machine slide drive apparatus according to the present invention.

FIG. 21 illustrates a third embodiment of the press machine slide drive apparatus according to the present invention. The parts common to those in FIG. 10 are assigned the same reference numerals and detailed explanations thereof will be omitted.

The slide drive control apparatus 300' shown in FIG. 21 is different from the slide drive control apparatus 300 shown in FIG. 10 in that it is provided with a slide velocity controller 310' instead of the slide position controller 310 in FIG. 10 and also provided with an external load estimation calculator 330' instead of the external load estimation calculator 330 in FIG. 10.

The slide velocity controller 310' is different mainly in that it is provided with a slide velocity command generator 311' instead of the slide position command generator 311 shown in FIG. 10. The slide velocity command generator 311' outputs an amount of slide velocity commanded indicating a target velocity every moment of the slide 102 to a first controller 312'. The first controller 312' is given a drive axis angular velocity detection signal, obtains a slide velocity detection signal from the drive axis angular velocity detection signal, performs closed-loop (feedback) control of velocity according to the amount of slide velocity commanded and the slide velocity detection signal and outputs the basic amount of slide control calculated to a second controller 313'. It is also possible to provide a drive axis angular velocity command generator that generates an amount of drive axis angular velocity commanded instead of the slide velocity command generator 311'.

On the other hand, the second controller 313' calculates an amount of correction by estimating molding torque and amount of disturbance such as friction from the drive axis angular velocity detection signal and the amount of slide control calculated and outputs this to a third controller 314'. The third controller 314' adds up the basic amount of slide control calculated and the amount of correction and outputs the addition result as an amount of slide control calculated so that the slide velocity (drive axis angular velocity) follows the amount of slide velocity commanded with high-speed response and high accuracy as a whole.

Furthermore, the external load estimation calculator 330' is different mainly in that it is provided with a first calculator 331' instead of the first calculator 331 of the external load estimation calculator 330 shown in FIG. 10. That is, while the first calculator 331 shown in FIG. 10 is given a pressure 1A signal, pressure 1B signal, pressure 2A signal and pressure 2B signal that act on both ports of the hydraulic pumps/motors P/M1 and P/M2, the first calculator 331' shown in FIG. 21 is given a pressure signal indicating the pressure of the constant high pressure source 220, an amount of hydraulic P/M1 drive commanded and an amount of hydraulic P/M2 drive commanded from the hydraulic pump/motor controller 350. Furthermore, the first calculator 331' stores estimated responsivity and displacements of the hydraulic pumps/motors P/M1 and P/M2 beforehand.

Then, the first calculator 331' estimates/calculates the differential pressure between both ports of the hydraulic pumps/motors P/M1 and P/M2 according to the pressure signal indicating the pressure of the constant high pressure source 220, calculates absolute values of the torques of the hydraulic pumps/motors P/M1 and P/M2 as values proportional to the product of the amount of hydraulic P/M1 drive commanded, amount of hydraulic P/M2 drive commanded by displacement and the differential pressure, further estimates an amount of calculation adding up the absolute values of the torques of the hydraulic pumps/motors P/M1 and P/M2 and estimated responsivity as the torques of the hydraulic pumps/motors P/M1 and P/M2 and outputs signals indicating estimated hydraulic P/M1 torque generated and estimated hydraulic P/M2 torque generated.

Figure 22A:
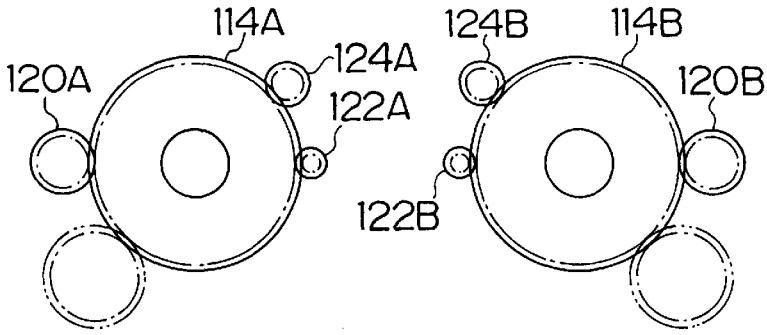
FIGS. 22(A) and 22(B) illustrate a fourth embodiment of the press machine slide drive apparatus according to the present invention.
Figure 22B:
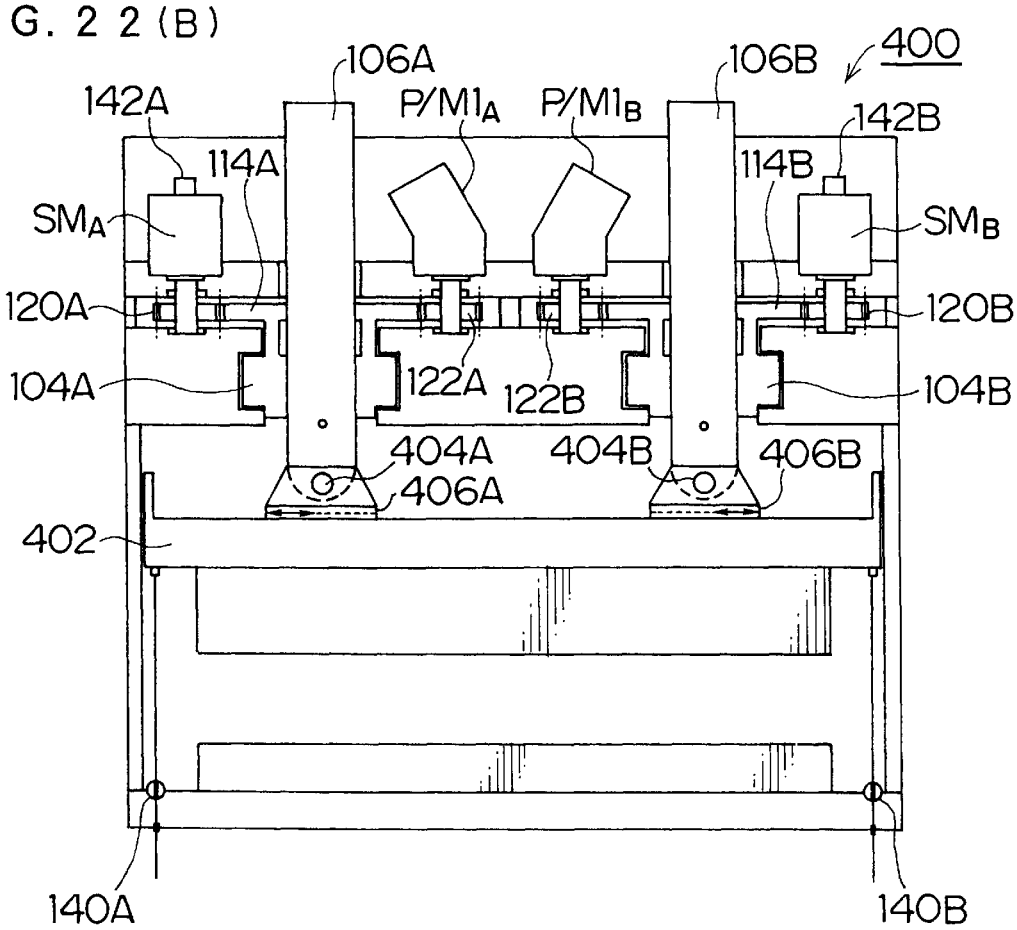

FIGS. 22(A) and 22(B) illustrate a fourth embodiment of the press machine slide drive apparatus according to the present invention.

In the screw press 400 shown in FIG. 22(B), one slide 402 is connected to a pair of left and right screw mechanisms (left-side screw mechanism made up of a drive nut 104A and a driven screw 106A, and right-side screw mechanism made up of a drive nut 104B and a driven screw 106B). Here, the lower end of the driven screw 106A is connected to the slide 402 via a rotation joint 404A that can freely tilt in the right/left direction of the slide 402 and a slide mechanism 406A that can freely slide in the right/left direction of the slide 402. Likewise, the lower end of the driven screw 106B is connected to the slide 402 via a rotation joint 404B that can freely tilt in the right/left direction of the slide 402 and a slide mechanism 406B that can freely slide in the right/left direction of the slide 402.

The drive nut 104A is provided with a ring gear 114A integral therewith and this ring gear 114A is engaged with a gear 120A which is provided for the drive axis of the electric motor $SM_A$ and at the same time engaged with gears 122A and 124A (see FIG. 22(A)) provided for the drive axes of the two hydraulic pumps/motors $P/M1_A$, etc.

Likewise, the drive nut 104B is provided with a ring gear 114B integral therewith and this ring gear 114B is engaged with a gear 120B which is provided for the drive axis of the electric motor $SM_B$ and at the same time engaged with gears 122B and 124B provided for the drive axes of the two hydraulic pumps/motors $P/M1_B$, etc.

Furthermore, the screw press 400 is provided with a pair of left and right slide position detectors 140A and 140B. The left-side slide position detector 140A detects the left-side position of the slide 402, outputs a left slide position signal indicating the left-side position to the slide drive control apparatus 600 (see FIG. 24) and the right-side slide position detector 140B detects the right-side position of the slide 402, outputs a right slide position signal indicating the right-side position to the slide drive control apparatus 600. The screw press 400 is further provided with drive axis angular velocity detectors $142_A$ and $142_B$ to detect the angular velocities of the drive axes of the left and right electric motors $SM_A$ and $SM_B$ and outputs a left drive axis angular velocity signal indicating the angular velocity and a right drive axis angular velocity signal indicating the angular velocity of the respective drive axes to the slide drive control apparatus 600.

Figure 23:
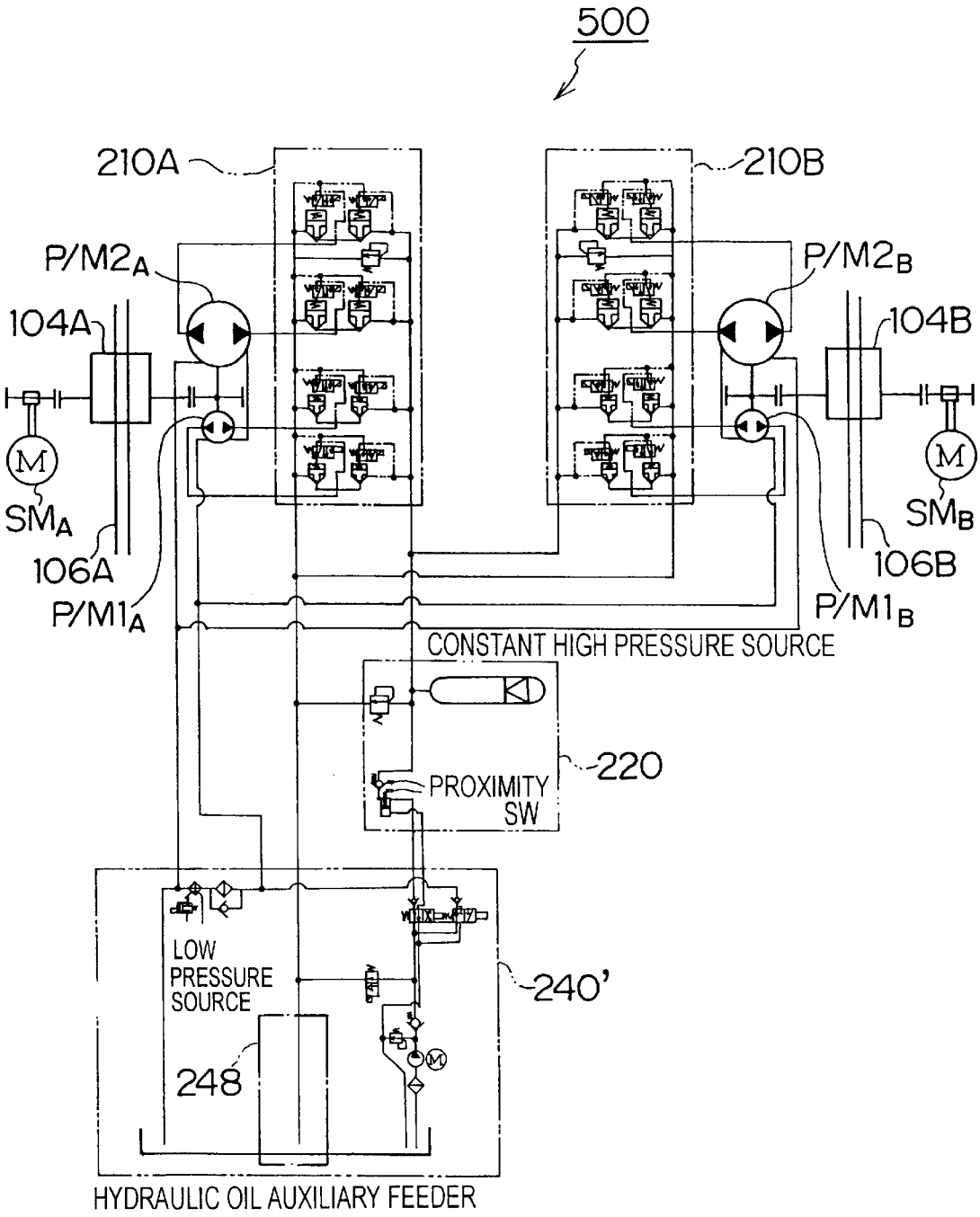
FIG. 23 illustrates the hydraulic pump/motor drive apparatus of the screw press shown in FIGS. 22(A) and 22(B)

FIG. 23 shows a hydraulic pump/motor drive apparatus 500 of the screw press 400.

This hydraulic pump/motor drive apparatus 500 is mainly constructed of a hydraulic oil switching control section 210A that switches between hydraulic oils to be supplied to the hydraulic pump/motor $P/M1_A$ and $P/M2_A$, a hydraulic oil switching control section 210B that switches between hydraulic oils to be supplied to the hydraulic pump/motor $P/M1_B$ and $P/M2_B$, a constant high pressure source 220 and a hydraulic oil auxiliary feeder 240' including a low pressure source 248.

This embodiment uses the constant high pressure source 220 and the hydraulic oil auxiliary feeder 240' common to the pair of hydraulic oil switching control sections 210A and 210B, but the constant high pressure source 220, etc. may also be provided independently.

Figure 24:
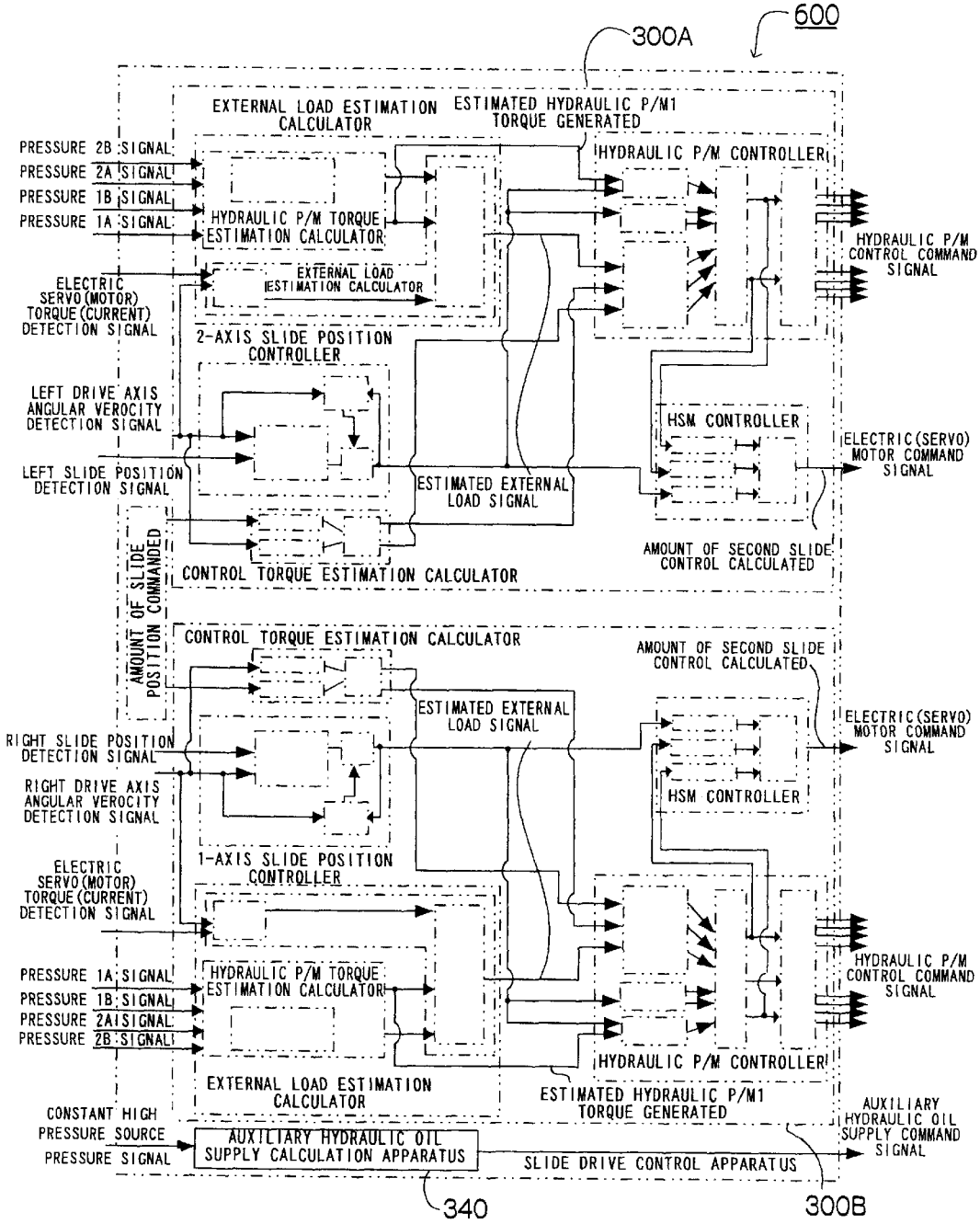
FIG. 24 illustrates the slide drive control apparatus of the screw press shown in FIGS. 22(A) and 22(B)

FIG. 24 shows the slide drive control apparatus 600 of the screw press 400.

The slide drive control apparatus 600 shown in the same figure is mainly constructed of left and right slide drive control apparatuses 300A and 300B.

This slide drive control apparatus 600 is provided with a slide position command generator 602 that generates an amount of slide position commanded and an auxiliary hydraulic oil supply calculator 340. The configurations of the slide drive control apparatuses 300A and 300B excluding the slide position command generator 602 and auxiliary hydraulic supply calculator 340 are the same as the configuration of the slide drive control apparatus 300 and detailed explanations thereof will be omitted.

The slide drive control apparatus 600 in the above configuration controls the drive torques to be applied to a pair of left and right screw mechanisms connected to the slide 402 individually, so that one slide target position and right and left position of the slide 402 may coincide, and therefore even in the case where decentered press weight is applied to the slide 402, the slide drive control apparatus 600 can perform torque control according to the decentered press weight and thereby maintain the parallelism of the slide 402 with high accuracy.

Figure 25A:
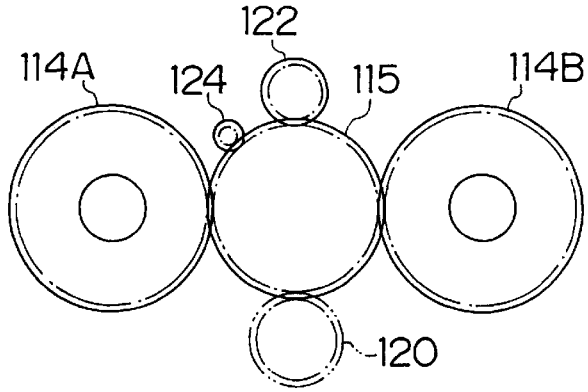
FIGS. 25(A) and 25(B) illustrate a fifth embodiment of the press machine slide drive apparatus according to the present invention.
Figure 25B:
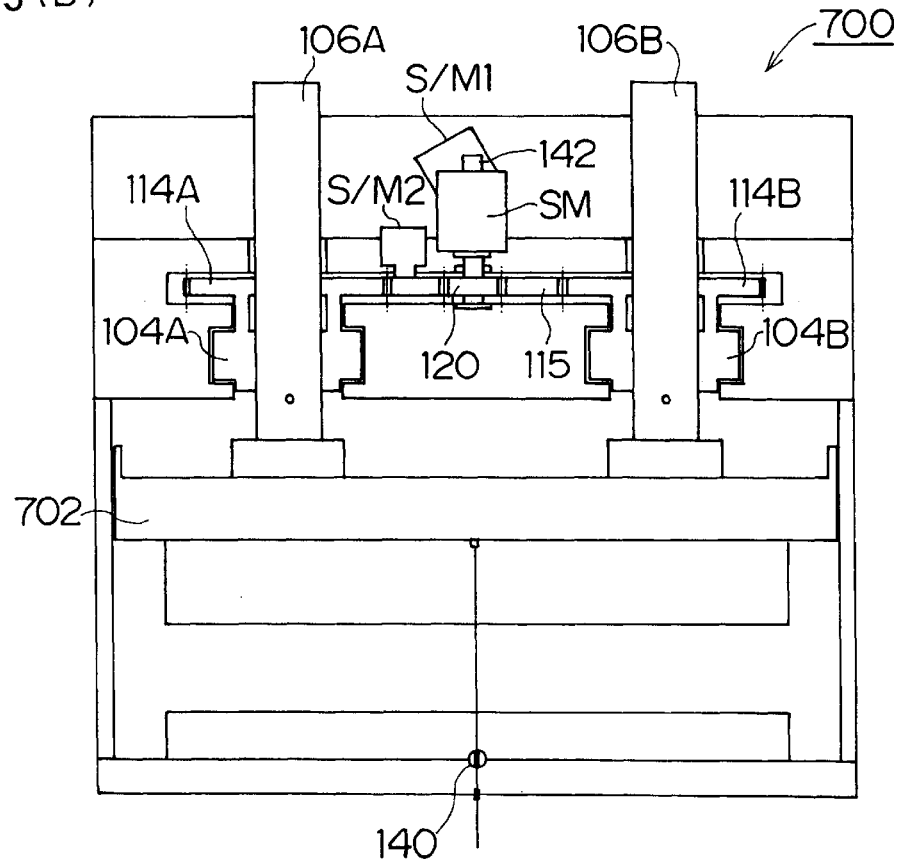

FIGS. 25(A) and 25(B) illustrate a fifth embodiment of the press machine slide drive apparatus according to the present invention.

In the screw press 700 shown in FIG. 25(B), one slide 702 is connected to a pair of left and right screw mechanisms (left-side screw mechanism made up of a drive nut 104A and a driven screw 106A, and right-side screw mechanism made up of a drive nut 104B and a driven screw 106B).

The drive nut 104A is provided with a ring gear 114A integral therewith and drive nut 104B is provided with a ring gear 114B integral therewith. These ring gears 114A and 114B are each engaged with a gear 115. This gear 115 is engaged with a gear 120 provided for the drive axis of the electric motor SM and at the same time is also engaged with gears 122 and 124 provided for the drive axes of the two hydraulic pumps/motors P/M1 and P/M2 (see FIG. 25(B)).

For this screw press 700, a hydraulic pump/motor drive apparatus and slide drive control apparatus similar to those shown in FIG. 1 can be used.

Even when decentered press weight is applied to the slide 702, the press machine slide drive apparatus in the above configuration distributes the rotation drive force corresponding to the decentered press weight to the respective screw mechanisms and can thereby maintain the parallelism of the slide 702 with high accuracy.

This embodiment uses a slide position signal as the position signal, but a drive axis angle signal can also be used. On the other hand, this embodiment uses a drive axis angular velocity as the velocity signal, but a slide velocity can also be used. This embodiment performs control using position feedback with a velocity minor loop feedback, but it is possible to perform control using only position feedback or velocity feedback. Furthermore, this embodiment has described the case where oil is used as the hydraulic liquid, but this embodiment is not limited to this and water or other liquids can also be used. Moreover, the hydraulic pump/motor is not limited to the fixed capacity type and a variable capacity type can also be used.

Furthermore, the drive apparatus using an electric motor and hydraulic pump/motor together is not limited to a press machine alone but can also be used as a drive apparatus for other equipment (for example, automobile).

As described above, the present invention combines an electric motor and a hydraulic pump/motor such as an oil hydraulic pump/motor on a torque level, and can thereby control the press machine with control by the electric motor and regenerate kinetic energy of the slide during braking without constraints of slide pressurization and the amount of energy (performance).

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A drive apparatus, comprising:

an electric motor;

a fixed capacity type or variable capacity type hydraulic pump/motor connected to a constant high pressure source that generates a quasi-constant pressure hydraulic liquid and a low pressure source; and a torque transmission device which mechanically connects a drive axis and the electric motor in such a way that torque is transmitted between the drive axis and the electric motor and mechanically connects the drive axis and the hydraulic pump/motor in such a way that torque is transmitted between the drive axis and the hydraulic pump/motor.

2. A press machine slide drive apparatus, comprising:

an electric motor;

a fixed capacity type or variable capacity type hydraulic pump/motor connected to a constant high pressure source that generates a quasi-constant high pressure hydraulic liquid and a low pressure source;

a slide drive mechanism which drives a slide of a press machine; and a power transmitting device which mechanically connects a drive axis of the slide drive mechanism and the electric motor in such a way that torque is transmitted between the drive axis of the slide drive mechanism and the electric motor and mechanically connects the drive axis and the hydraulic pump/motor in such a way that torque is transmitted between the drive axis and the hydraulic pump/motor.

3. The press machine slide drive apparatus according to claim 2, wherein the constant high pressure source comprises an accumulator which is kept at a quasi-constant high pressure.

4. The press machine slide drive apparatus according to claim 2 or 3, wherein the low pressure source comprises a tank at an atmospheric pressure or an accumulator which is kept at a quasi-constant low pressure.

5. The press machine slide drive apparatus according to claim 2, wherein the hydraulic pump/motor comprises a valve which changes connections so that the pressure sources connected to two hydraulic connection ports apply to following case 1 to case 3:

| | Port A | Port B |
|---|---|---|
| Case 1 | Low pressure source | Low pressure source |
| Case 2 | Low pressure source | Constant high pressure source |
| Case 3 | Constant high pressure source | Low pressure source |

6. The press machine slide drive apparatus according to claim 2, wherein the constant high pressure source is connected with a hydraulic liquid auxiliary feeder which supplies a quasi-constant high pressure hydraulic liquid.

7. The press machine slide drive apparatus according to claim 6, wherein the hydraulic liquid auxiliary feeder comprises a hydraulic pump which is driven at least by an electric motor and supplies a hydraulic liquid to the constant high pressure source.

8. The press machine slide drive apparatus according to claim 6 or 7, wherein the hydraulic liquid auxiliary feeder comprises:

a hydraulic pressure detecting device which detects a hydraulic pressure acting on the constant high pressure source; and an auxiliary hydraulic liquid supply control device which controls the hydraulic liquid supplied to the constant high pressure source according to the hydraulic pressure detected by the hydraulic pressure detecting device.

9. The press machine slide drive apparatus according to claim 2, wherein the electric motor comprises a plurality of electric motors including at least one servo motor.

10. The press machine slide drive apparatus according to claim 2, wherein the electric motor comprises a plurality of electric motors including at least one inverter drive motor.

11. The press machine slide drive apparatus according to claim 2, wherein:

the press machine is a screw press provided with a screw mechanism as the slide drive mechanism; and the drive axis of the slide drive mechanism is an axis connected to a screw via the screw of the screw press, nut or reduction gear or an axis connected to a nut via a reduction gear, etc.

12. The press machine slide drive apparatus according to claim 2, further comprising:

a first detecting device which detects the position of the slide of the press machine or the angle of the drive axis of the slide drive mechanism;

a second detecting device which detects the velocity of the slide or the angular velocity of the drive axis;

a command device which commands a target position of the slide of the press machine or a target angle of the drive axis; and a control device which controls the electric motor and hydraulic pump/motor according to the slide target position or drive axis target angle commanded by the command device, the slide position or the angle of the drive axis detected by the first detecting device and the slide velocity or angular velocity of the drive axis detected by the second detecting device.

13. The press machine slide drive apparatus according to claim 2, further comprising:

a detecting device which detects the velocity of the slide of the press machine or the angular velocity of the drive axis of the slide drive mechanism;

a command device which commands a target velocity of the slide of the press machine or a target angular velocity of the drive axis; and a control device which controls the electric motor and hydraulic pump/motor according to the slide target velocity or drive axis target angular velocity commanded by the command device and the slide velocity or the drive axis angular velocity detected by the detecting device.

14. The press machine slide drive apparatus according to claim 12, wherein the control device comprises:

a calculating device which calculates a first amount of slide control calculated according to the slide target position or drive axis target angle commanded by the command device and the slide position or the drive axis angle detected by the first detecting device and the slide velocity or drive axis angular velocity detected by the second detecting device; and a combined control device which calculates a second amount of slide control calculated according to the first amount of slide control calculated and the amount of command to the hydraulic pump/motor and controls the electric motor according to the second amount of slide control calculated.

15. The press machine slide drive apparatus according to claim 13, wherein the control device comprises:

a calculating device which calculates a first amount of slide control calculated according to the slide target velocity or drive axis target angular velocity commanded by the command device and the slide velocity or the drive axis angular velocity detected by the detecting device; and a combined control device which calculates a second amount of slide control calculated according to the first amount of slide control calculated and the amount of command to the hydraulic pump/motor and controls the electric motor according to the second amount of slide control calculated.

16. The press machine slide drive apparatus according to claim 12, wherein the control device comprises:

a calculating device which calculates an amount of slide control calculated according to the slide target position or drive axis target angle commanded by the command device, the slide position or the drive axis angle detected by the first detecting device and the slide velocity or the drive axis angular velocity detected by the second detecting device;

a first hydraulic pump/motor control calculating device which determines excess or deficiency of output torque of the electric motor according to the amount of slide control calculated and calculates a first amount of calculation of hydraulic pump/motor control in the case of deficiency; and an outputting device which outputs an amount of command to the hydraulic pump/motor according to the first amount of calculation of hydraulic pump/motor control.

17. The press machine slide drive apparatus according to claim 13, wherein the control device comprises:

a calculating device which calculates a first amount of slide control calculated according to the slide target velocity or drive axis target angular velocity commanded by the command device and the slide velocity or drive axis angular velocity detected by the detecting device;

a first hydraulic pump/motor control calculating device which determines excess or deficiency of output torque of the electric motor according to the amount of slide control calculated and calculates a first amount of calculation of hydraulic pump/motor control in the case of deficiency; and an outputting device which outputs an amount of command to the hydraulic pump/motor according to the first amount of calculation of hydraulic pump/motor control.

18. The press machine slide drive apparatus according to claim 12, wherein the control device comprises:

a calculating device which calculates an amount of slide control calculated according to the slide target position or drive axis target angle commanded by the command device, the slide position or drive axis angle detected by the first detecting device and the slide velocity or drive axis angular velocity detected by the second detecting device;

a first hydraulic pump/motor control calculating device which determines excess or deficiency of output torque of the electric motor according to the amount of slide control calculated and calculates a first amount of calculation of hydraulic pump/motor control in the case of deficiency;

a torque estimating/calculating device which estimates torque generated by the hydraulic pump/motor;

a second hydraulic pump/motor control calculating device which calculates a second amount of calculation of hydraulic pump/motor control according to the amount of slide control calculated and the estimated amount of calculation of torque estimated by the torque estimating/calculating device; and a comparing/calculating device which outputs an amount of command to the hydraulic pump/motor according to the result of comparison between the first and second amounts of calculation of hydraulic pump/motor control.

19. The press machine slide drive apparatus according to claim 13, wherein the control device comprises:

a calculating device which calculates an amount of slide control calculated according to the slide target velocity or drive axis target angular velocity commanded by the command device and the slide velocity or drive axis angular velocity detected by the detecting device;

a first hydraulic pump/motor control calculating device which determines excess or deficiency of output torque of the electric motor according to the amount of slide control calculated and calculates a first amount of calculation of hydraulic pump/motor control in the case of deficiency;

a torque estimating/calculating device which estimates torque generated by the hydraulic pump/motor;

a second hydraulic pump/motor control calculating device which calculates a second amount of calculation of hydraulic pump/motor control according to the amount of slide control calculated and the estimated amount of torque calculation estimated by the torque estimating/calculating device; and a comparing/calculating device which outputs an amount of command to the hydraulic pump/motor according to the result of comparison between the first and second amount of calculation of hydraulic pump/motor control.

20. The press machine slide drive apparatus according to claim 12, wherein the control device comprises:

a calculating device which calculates an amount of slide control calculated according to the slide target position or drive axis target angle commanded by the command device, the slide position or drive axis angle detected by the first detecting device and the slide velocity or drive axis angular velocity detected by the second detecting device;

a first hydraulic pump/motor control calculating device which determines excess or deficiency of output torque of the electric motor according to the amount of slide control calculated and calculates a first amount of calculation of hydraulic pump/motor control in the case of deficiency;

a torque estimating/calculating device which estimates torque generated by the hydraulic pump/motor;

a second hydraulic pump/motor control calculating device which calculates a second amount of calculation of hydraulic pump/motor control according to the amount of slide control calculated and the estimated amount of calculation of torque estimated by the torque estimating/calculating device;

an external load estimating/calculating device which estimates external load corresponding to the press weight during a press operation;

a braking torque estimating/calculating device which estimates braking torque during a press operation;

a third hydraulic pump/motor control calculating device which calculates a third amount of calculation of hydraulic pump/motor control according to the estimated external load and braking torque; and a comparing/calculating device which outputs an amount of command to the hydraulic pump/motor according to the result of comparison between the first, second and third amounts of calculation of hydraulic pump/motor control.

21. The press machine slide drive apparatus according to claim 13, wherein the control device comprises:

a calculating device which calculates an amount of slide control calculated according to the slide target velocity or drive axis target angular velocity commanded by the command device and the slide velocity or drive axis angular velocity detected by the detecting device;

a first hydraulic pump/motor control calculating device which determines excess or deficiency of output torque of the electric motor according to the amount of slide control calculated and calculates a first amount of calculation of hydraulic pump/motor control in the case of deficiency;

a torque estimating/calculating device which estimates torque generated by the hydraulic pump/motor;

a second hydraulic pump/motor control calculating device which calculates a second amount of calculation of hydraulic pump/motor control according to the amount of slide control calculated and the estimated amount of calculation of torque estimated by the torque estimating/calculating device;

an external load estimating/calculating device which estimates external load corresponding to the press weight during a press operation;

a braking torque estimating/calculating device which estimates braking torque during a press operation;

a third hydraulic pump/motor control calculating device which calculates a third amount of calculation of hydraulic pump/motor control according to the estimated external load and braking torque; and a comparing/calculating device which outputs an amount of command to the hydraulic pump/motor according to the result of comparison between the first, second and third amounts of calculation of hydraulic pump/motor control.

22. The press machine slide drive apparatus according to any one of claims 18 to 21, wherein the torque estimating/calculating device comprises:

a hydraulic pressure detecting device which detects a hydraulic pressure that acts on hydraulic pressure connection ports on one side or both sides of the hydraulic pump/motor; and a calculating device which calculates an estimated amount of calculation of torque according to the hydraulic pressure detected by the hydraulic pressure detecting device and displacement of the hydraulic pump/motor.

23. The press machine slide drive apparatus according to any one of claims 18 to 21, wherein the torque estimating/calculating device calculates an estimated amount of calculation of torque according to estimated responsivity from the amount of command to the hydraulic pump/motor to torque generated of the hydraulic pump/motor, the displacement of the hydraulic pump/motor and the hydraulic pressure acting on the constant high pressure source.

24. The press machine slide drive apparatus according to claim 20 or 21, wherein the external load estimating/calculating device comprises:

a detecting device which detects output torque of the electric motor; and an external load estimating/calculating device which calculates the external load according to the slide velocity or drive axis angular velocity, the detected output torque of the electric motor and the estimated torque generated by the hydraulic pump/motor.

25. The press machine slide drive apparatus according to claim 20, wherein the braking torque estimating/calculating device estimates/calculates braking torque according to the slide target position or drive axis target angle commanded by the command device or the slide velocity or drive axis angular velocity detected by the second detecting device.

26. The press machine slide drive apparatus according to claim 21, wherein the braking torque estimating/calculating device estimates/calculates braking torque according to the slide target velocity or drive axis target angular velocity commanded by the command device or the slide velocity or drive axis angular velocity detected by the detecting device.

27. A press machine slide drive apparatus, comprising:

an electric motor;

a fixed capacity type or variable capacity type hydraulic pump/motor connected to a constant high pressure source that generates a quasi-constant high pressure hydraulic liquid and a low pressure source;

a plurality of slide drive mechanisms which drives one slide of the press machine; and a power transmission device which mechanically connects each drive axis and the electric motor in the plurality of slide drive mechanisms in such a way that torque is transmitted between each drive axis and the electric motor and mechanically connects the each drive axis and the hydraulic pump/motor in such a way that torque is transmitted between the each drive axis and the hydraulic pump/motor.

28. The press machine slide drive apparatus according to claim 27, wherein at least one of the electric motor and hydraulic pump/motor is provided for each drive axis, the power transmission device transmits torque of the electric motor and hydraulic pump/motor provided for each drive axis to each drive axis independently.

29. The press machine slide drive apparatus according to claim 27, comprising a synchronizing mechanism which mechanically synchronizes each drive axis of the plurality of slide drive mechanisms, wherein the power transmission device distributes and transmits the drive power of the electric motor and hydraulic pump/motor to each drive axis via the synchronizing mechanism.

30. The press machine slide drive apparatus according to claim 28, comprising:

a plurality of first detecting devices which detect a plurality of right/left or front/back and right/left slide positions of the press machine or each angle of the drive axis of the plurality of slide drive mechanisms;

a plurality of second detecting devices which detect a plurality of right/left or front/back and right/left slide velocities of the slide or each angular velocity of the drive axis of the plurality of slide drive mechanisms;

a command device which commands a target position of the press machine or a target angle of the drive axis; and a control device which controls the electric motor and hydraulic pump/motor provided for the each drive axis according to the slide target position or drive axis target angle commanded by the command device, the plurality of slide positions or drive axis angles detected by the first detecting devices and the plurality of slide velocities or drive axis angular velocities detected by the second detecting devices.

31. The press machine slide drive apparatus according to claim 29, further comprising:

a first detecting device which detects the slide position of the press machine or angle of the drive axis of the slide drive mechanism;

a second detecting device which detects the velocity of the slide or angular velocity of the drive axis;

a command device which commands the target position of the slide of the press machine or target angle of the drive axis; and a control device which controls the electric motor and hydraulic pump/motor according to the slide target position or drive axis target angle commanded by the command device, the slide position or drive axis angle detected by the first detecting device and the slide velocity or drive axis angular velocity detected by the second detecting device.

32. The press machine slide drive apparatus according to claim 28, wherein one the constant high pressure source and one low pressure source are provided and connected in such a way as to be shared by the plurality of hydraulic pumps/motors.

33. A press machine slide drive method, comprising the steps of:

driving an electric motor and-mechanically connected to a drive axis, thereby generating torque;

generating torque from a fixed capacity type or variable capacity type hydraulic pump/motor by connecting the hydraulic pump/motor to a constant high pressure source which generates a quasi-constant high pressure hydraulic liquid and low pressure source; and combining and acting the output torque of the electric motor and the output torque of the hydraulic pump/motor on the drive axis when the output torque of at least the single electric motor unit is not sufficient as the torque output to the drive axis of the press machine slide drive mechanism.

34. The press machine slide drive method according to claim 33, further comprising the steps of:

rendering the hydraulic pump/motor to operate as a hydraulic pump when the slide is decelerated in one cycle of the press machine; and storing the whole or part of the kinetic energy of the slide in the constant high pressure source as a hydraulic liquid.

35. The press machine slide drive method according to claim 34, wherein the hydraulic pump/motor comprises a plurality of hydraulic pumps/motors, some of the plurality of hydraulic pumps/motors are operated as hydraulic motors and the whole or part of the kinetic energy of the slide is stored in the constant high pressure source as a hydraulic liquid by total input/output torque of the plurality of hydraulic pumps/motors.

36. The press machine slide drive method according to claim 33, further comprising the steps of:

driving the electric motor in the slide acceleration direction when the slide is decelerated in one cycle of the press machine;

operating the hydraulic pump/motor as a hydraulic pump; and storing the kinetic energy of the slide and the output torque of the hydraulic pump/motor in the constant high pressure source as a hydraulic liquid.

37. The press machine slide drive method according to claim 33, further comprising the steps of:

rendering the hydraulic pump/motor to operate as a hydraulic pump when load in one cycle of the press machine is low;

generating torque larger than the torque required for the low load from the electric motor in such a way as to balance with the low load and the load of the hydraulic pump/motor; and storing surplus energy caused by surplus torque of the electric motor caused by the pump operation of the hydraulic pump/motor in the constant high pressure source as a hydraulic liquid.

38. The press machine slide drive method according to claim 37, further comprising the steps of:

rendering the hydraulic pump/motor to operate as a hydraulic pump when the slide is decelerated in one cycle of the press machine; and storing the whole or part of the kinetic energy of the slide in the constant high pressure source as a hydraulic liquid.

39. The press machine slide drive method according to claim 38, wherein the hydraulic pump/motor comprises a plurality of hydraulic pumps/motors, some of the plurality of hydraulic pumps/motors are operated as hydraulic motors and the whole or part of the kinetic energy of the slide is stored in the constant high pressure source as a hydraulic liquid by total input/output torque of the plurality of hydraulic pumps/motors.

40. The press machine slide drive method according to claim 37, further comprising the steps of:

driving the electric motor in the slide acceleration direction when the slide is decelerated in one cycle of the press machine;

operating the hydraulic pump/motor as a hydraulic pump; and storing the kinetic energy of the slide and the output torque of the hydraulic pump/motor in the constant high pressure source as a hydraulic liquid.

41. The press machine slide drive method according to claim 37, wherein a hydraulic pump/motor of a small displacement type is used for the hydraulic pump/motor so as to operate as a hydraulic pump by the surplus torque when connected to the constant high pressure source and low pressure source or the capacity of the hydraulic pump/motor is made variable so as to have smaller displacement.

42. The press machine slide drive method according to claim 41, further comprising the steps of:

rendering the hydraulic pump/motor to operate as a hydraulic pump when the slide is decelerated in one cycle of the press machine; and storing the whole or part of the kinetic energy of the slide in the constant high pressure source as a hydraulic liquid.

43. The press machine slide drive method according to claim 42, wherein the hydraulic pump/motor comprises a plurality of hydraulic pumps/motors, some of the plurality of hydraulic pumps/motors are operated as hydraulic motors and the whole or part of the kinetic energy of the slide is stored in the constant high pressure source as a hydraulic liquid by total input/output torque of the plurality of hydraulic pumps/motors.

44. The press machine slide drive method according to claim 41, further comprising the steps of:

driving the electric motor in the slide acceleration direction when the slide is decelerated in one cycle of the press machine;

operating the hydraulic pump/motor as a hydraulic pump; and storing the kinetic energy of the slide and the output torque of the hydraulic pump/motor in the constant high pressure source as a hydraulic liquid.

45. The press machine slide drive method according to any one of claims 33 to 44, wherein the hydraulic pump/motor inputs/outputs predetermined torque to accelerate or decelerate the drive axis during operation and controls the magnitude and direction of the output torque of the electric motor so that the torque required by the drive axis during press operation and the torque combining the predetermined torque of the hydraulic pump/motor and the output torque of the electric motor are balanced.

46. The press machine slide drive method according to claim 45, wherein the hydraulic pump/motor in operation controls the electric motor according to the amount of command obtained by subtracting the amount of command corresponding to the torque of the hydraulic pump/motor from the amount of command corresponding to the torque required by the drive axis.

47. The press machine slide drive method according to claim 46, wherein the amount of command corresponding to the torque of the hydraulic pump/motor is multiplied by an estimated transfer function corresponding to the torque responsivity of the hydraulic pump/motor.

* * * * *